US008998778B2

(12) United States Patent
Potts et al.

(10) Patent No.: US 8,998,778 B2
(45) Date of Patent: Apr. 7, 2015

(54) EXERCISE WEIGHTS AND BARBELLS THEREFOR

(71) Applicants: Terence Scott Potts, Hamilton (CA); Paul William Dorsett, Campbellville (CA)

(72) Inventors: Terence Scott Potts, Hamilton (CA); Paul William Dorsett, Campbellville (CA)

(73) Assignee: Terence S. Potts (CA)

( * ) Notice: Subject to any disclaimer, the term of this patent is extended or adjusted under 35 U.S.C. 154(b) by 135 days.

(21) Appl. No.: 13/850,947

(22) Filed: Mar. 26, 2013

(65) Prior Publication Data

US 2014/0024505 A1 Jan. 23, 2014

Related U.S. Application Data

(63) Continuation-in-part of application No. 13/551,592, filed on Jul. 17, 2012.

(51) Int. Cl.
*A63B 21/00* (2006.01)
*A63B 21/072* (2006.01)

(52) U.S. Cl.
CPC ..... *A63B 21/0724* (2013.01); *A63B 21/072* (2013.01); *A63B 21/0728* (2013.01); *A63B 21/1469* (2013.01)

(58) Field of Classification Search
USPC ..... 482/104, 106, 108, 49
See application file for complete search history.

(56) References Cited

U.S. PATENT DOCUMENTS

| | | | | |
|---|---|---|---|---|
| 1,422,888 | A | 7/1922 | Reeves et al. | |
| 3,265,389 | A | 8/1966 | Carlson | |
| D275,302 | S | 8/1984 | Rotella | |
| 5,792,035 | A * | 8/1998 | Ward et al. | 482/140 |
| D409,695 | S | 5/1999 | Rojas et al. | |
| 6,050,925 | A | 4/2000 | Irvin et al. | |
| D431,059 | S | 9/2000 | Webber et al. | |
| D451,159 | S | 11/2001 | Rojas et al. | |
| D451,160 | S | 11/2001 | Rojas et al. | |
| 6,406,409 | B1 * | 6/2002 | Silver | 482/104 |
| D519,173 | S | 4/2006 | Nalley | |
| D528,180 | S | 9/2006 | Rathbun | |
| D534,232 | S | 12/2006 | Rathbun | |
| D562,416 | S | 2/2008 | Fedriga et al. | |
| D568,423 | S | 5/2008 | Y'shua et al. | |
| D572,320 | S | 7/2008 | Davies, III | |
| 7,608,021 | B1 | 10/2009 | Nalley | |
| 8,052,587 | B1 | 11/2011 | Wu | |
| D665,469 | S | 8/2012 | Zabel | |
| 2010/0069206 | A1 * | 3/2010 | Viselman | 482/106 |
| 2010/0160124 | A1 * | 6/2010 | Berenshteyn | 482/106 |
| 2010/0323854 | A1 * | 12/2010 | Brandenburg | 482/106 |
| 2014/0024505 | A1 * | 1/2014 | Potts et al. | 482/106 |

* cited by examiner

*Primary Examiner* — Jerome w Donnelly
(74) *Attorney, Agent, or Firm* — Steven M. Greenberg; CRGO Law

(57) ABSTRACT

An exercise weight comprises a plate having a width, a length and a thickness. The length is substantially greater than the width, and the width is substantially greater than the thickness. The plate has opposed longitudinal edges and opposed end edges, and has opposed lengthwise grip apertures adjacent respective longitudinal edges and opposed end grip apertures adjacent respective end edges. The grip apertures cooperate with their respective edges to form lengthwise handgrips and end handgrips. A barbell comprises a main support portion for receiving exercise weights and which includes at least one mounting projection adapted to be received in a corresponding aperture in one of the exercise weights to support the exercise weight on the barbell. Opposed lifting handles extend outwardly from opposite ends of the main support portion and an elongated lifting bar is carried by and spaced from the main support portion.

20 Claims, 35 Drawing Sheets

EXERCISE WEIGHTS AND BARBELLS THEREFOR

CROSS-REFERENCE TO RELATED APPLICATION

This application is a continuation-in-part of U.S. patent application Ser. No. 13/551,592 filed on Jul. 17, 2012, the teachings of which are hereby incorporated by reference.

TECHNICAL FIELD

The present disclosure relates to exercise equipment, and more particularly to exercise weights and to barbells on which exercise weights may be removably mounted.

BACKGROUND

Resistance training, particularly using weight, is a popular form of exercise, whether for aesthetic improvement by increasing muscle size and/or tone or as part of a regime directed at overall health and wellness.

Barbells with weights are a common type of exercise equipment. Typically, a barbell will take the form of an elongate shaft with flanges disposed inwardly of each end. Weight plates, which are typically disc-shaped or hexagon-shaped, are placed on each end of the barbell by aligning a central mounting aperture in the weight plate with the end of the barbell and sliding the weight plate along the end of the barbell until the weight plate abuts the flange or the innermost weight on that side of the barbell. This enables the weight of the barbell to be varied according to the exercise being performed and the capability of the person performing the exercise.

In some cases, an individual may perform an exercise using one or more weight plates, without using a barbell. For example, an exercise known as a "front raise" or "front deltoid raise" may be performed by a user gripping the edges of a disc-shaped weight plate and raising his or her arms in front of the body. To facilitate this type of exercise, some disc-shaped weight plates include grip apertures adjacent the edges of the weight plate. U.S. Pat. No. D572320 to Davies teaches a disc-shaped weight plate with equally spaced grip apertures disposed adjacent the edge of the weight plate.

SUMMARY

An exercise weight comprises a plate having a width, a length and a thickness. The length is substantially greater than the width and the width is substantially greater than the thickness. The plate has opposed longitudinal edges defined by the length and opposed longitudinal ends having end edges. The plate has at least one pair of opposed lengthwise grip apertures defined through the plate adjacent respective ones of the opposed longitudinal edges thereof, with each lengthwise grip aperture cooperating with its respective longitudinal edge to form a lengthwise handgrip, and at least one pair of opposed end grip apertures defined through the plate adjacent respective ones of the end edges thereof, with each end grip aperture cooperating with its respective end edge to form an end handgrip.

The exercise weight may further comprise at least one mounting aperture defined through the plate for mounting the weight on a barbell and disposed inwardly of the lengthwise grip apertures and the end grip apertures. The at least one mounting aperture preferably comprises at least one pair of opposed mounting apertures.

The opposed lengthwise grip apertures may consist of a single pair of opposed lengthwise grip apertures and the opposed end grip apertures may consist of a single pair of opposed end grip apertures.

Preferably, the length of the plate is at least double the width of the plate.

In one embodiment, the plate has a generally rectangular parallelepipedic shape, and may have rounded corners. In other embodiments, the longitudinal edges and end edges may be linear, of convex curvature or of concave curvature in any suitable combination.

A barbell, which may be used in association with the above-described exercise weights, comprises a main support portion for receiving exercise weights, a pair of opposed first lifting handles extending outwardly from opposite ends of the main support portion, and an elongated lifting bar carried by the main support portion. The main support portion includes at least one mounting projection, with each mounting projection adapted to be received in a corresponding aperture in one of the exercise weights for supporting the exercise weight on the barbell, and the elongated lifting bar is spaced from and extends along the main support portion. In one embodiment, the barbell has two spaced apart mounting projections.

The barbell may comprise a pair of opposed second lifting handles, with each of the second lifting handles extending from a respective one of the first lifting handles and extending away from the lifting bar.

The barbell may comprise a pair of spaced-apart legs, each extending from the main support portion away from the lifting bar for supporting the barbell on a surface while mounting the exercise weights thereon.

The barbell may comprise a pair of spacer arms extending between the main support portion and the lifting bar, with the spacer arms positioned opposite the legs. In one embodiment, the lifting bar extends between the spacer arms so that the spacer arms define the ends of the lifting bar. The lifting bar may include outwardly bowed grip portions at opposite ends thereof. A crossbar may extend between the legs.

BRIEF DESCRIPTION OF THE DRAWINGS

These and other features will become more apparent from the following description in which reference is made to the appended drawings wherein.

DETAILED DESCRIPTION

Figure 1:
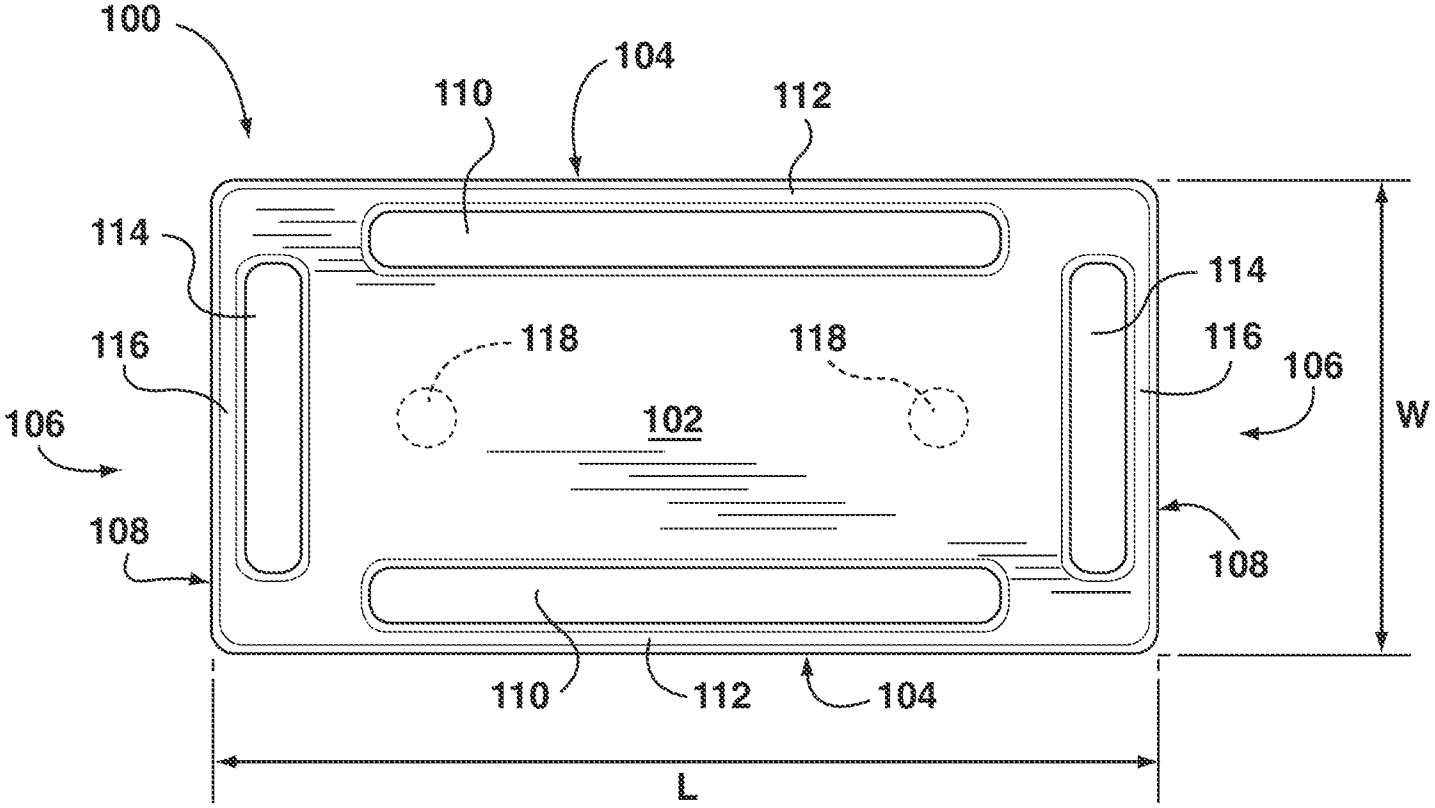
FIG. 1 shows a plan view of a first exemplary exercise weight.
Figure 2:
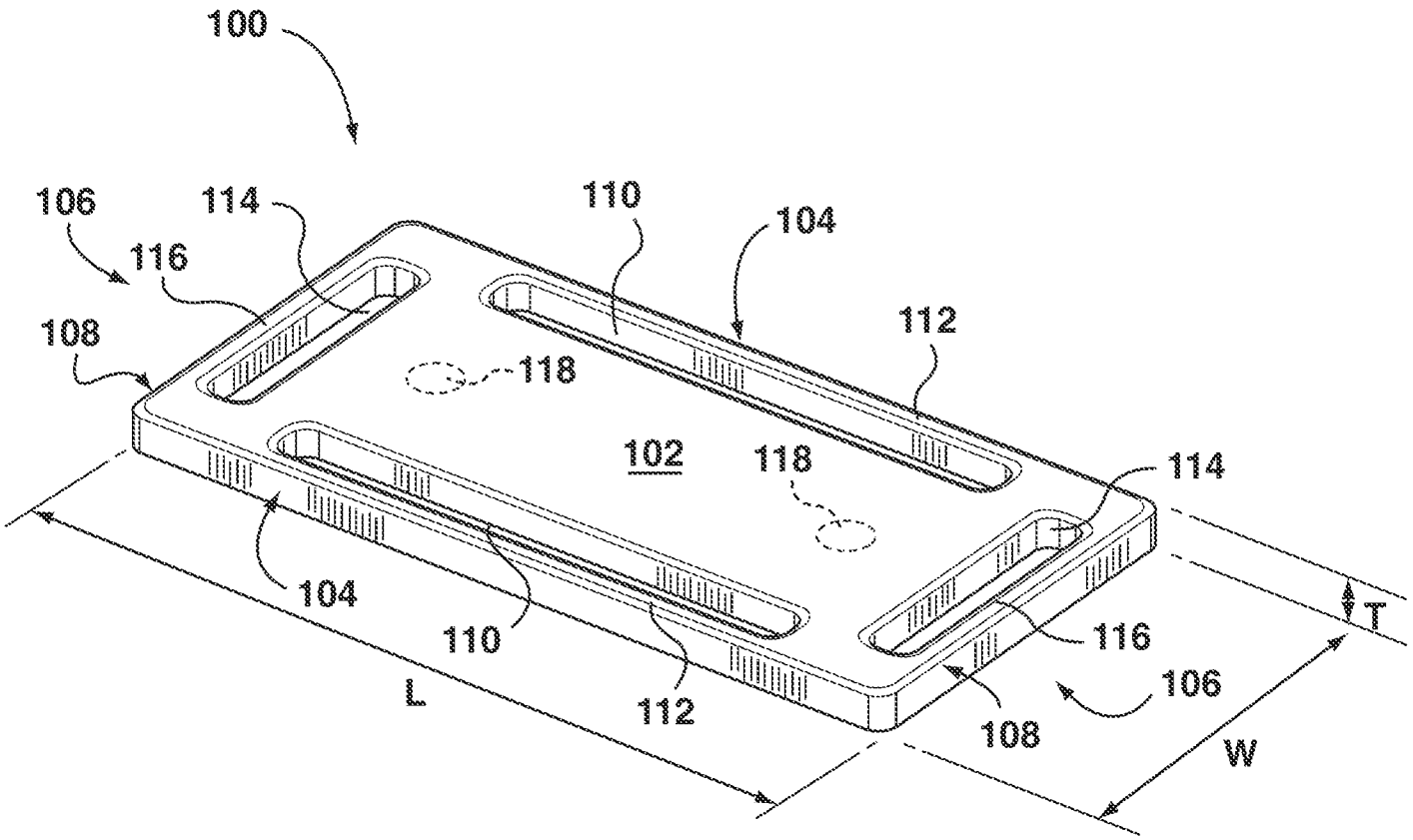
FIG. 2 shows a perspective view of the exemplary exercise weight of FIG. 1.

Reference is now made to FIGS. 1 and 2, in which a first exemplary exercise weight is indicated generally by the reference numeral 100. The exercise weight 100 comprises a plate 102 having a width W, a length L and a thickness T (FIG. 2). The plate 102 may be made from any suitable material that is used conventionally for exercise weights, such as steel or cast iron, and may be coated with rubber or another suitable material to inhibit rust and improve grip. Alternatively, although less preferred, the plate 102 may comprise a hollow member, for example from plastic, which may be filled with a weighted material such as concrete or cement, or even water. For example, the plate 102 may include a removable sealing cap (not shown) for adding and removing water so as to make the plate 102 suitable for air travel, since it could be transported empty and then filled with water at the user's destination.

As can be seen in FIGS. 1 and 2, the length L of the plate 102 is substantially greater than the width W of the plate 102; preferably the length L is at least 1.5 times the width W and still more preferably the length L is at least double the width W. In addition, the width W of the plate 102 is substantially greater than the thickness T of the plate 102. Suitable dimensions for the plate 102 are a length L of 20 inches, a width W of 10 inches and a thickness of between ¾ inches and 1 inch; these are exemplary dimensions only and many other dimensions are also suitable.

The plate 102 has opposed longitudinal edges 104 defined by the length L and opposed longitudinal ends 106 having end edges 108. In the exemplary embodiment shown in FIGS. 1 and 2, the plate 102 has a generally rectangular parallelepiped or cuboid shape, with rounded corners, and as such the longitudinal edges 104 and end edges 108 of the exemplary plate 102 are substantially linear. In other embodiments, as described below, one or both of the longitudinal edges and/or the end edges may be slightly curved.

The plate 102 includes at least one pair of opposed lengthwise grip apertures 110 defined through the plate 102 adjacent respective longitudinal edges 104 of the plate 102. Each of the lengthwise grip apertures 110 cooperates with its respective longitudinal edge 104 to form a lengthwise handgrip 112.

The plate 102 also includes a pair of opposed end grip apertures 114 defined through the plate 102 adjacent respective end edges 108 of the plate 102, with each end grip aperture 114 cooperating with its respective end edge 108 to form an end handgrip 116. Although it is possible to have more than one pair of opposed end grip apertures when the end edges of the plate are of sufficient length, for typical dimensions of the plate, such as a length L of 20 inches and a width W of 10 inches, it is preferred to have only a single pair of opposed end grip apertures, as shown.

In the illustrated embodiment, the plate 102 also has a pair of opposed, spaced-apart mounting apertures 118 defined therethrough, inwardly of the lengthwise grip apertures 110 and the end grip apertures 114. The mounting apertures 118 are used for mounting the weight 100 on a barbell, as explained in further detail below. Although the mounting apertures 118 are shown as circular in the Figures, they may in practice have any suitable shape, such as square, hexagon, octagon or others. Furthermore, while the exemplary weight 100 includes two separate mounting apertures 118, in other embodiments only a single mounting aperture may be used. Moreover, in further alternate embodiments the weight may not include any separate mounting apertures, and instead the lengthwise grip apertures and/or the end grip apertures may be used to mount the weight on a barbell. Hence, the mounting apertures 118 are shown in dashed lines.

In the exemplary embodiment shown in FIGS. 1 and 2, the plate 102 is provided with a single pair of opposed lengthwise grip apertures 110; in other embodiments the plate may be provided with more than one pair of pair of opposed lengthwise grip apertures.

Figure 3:
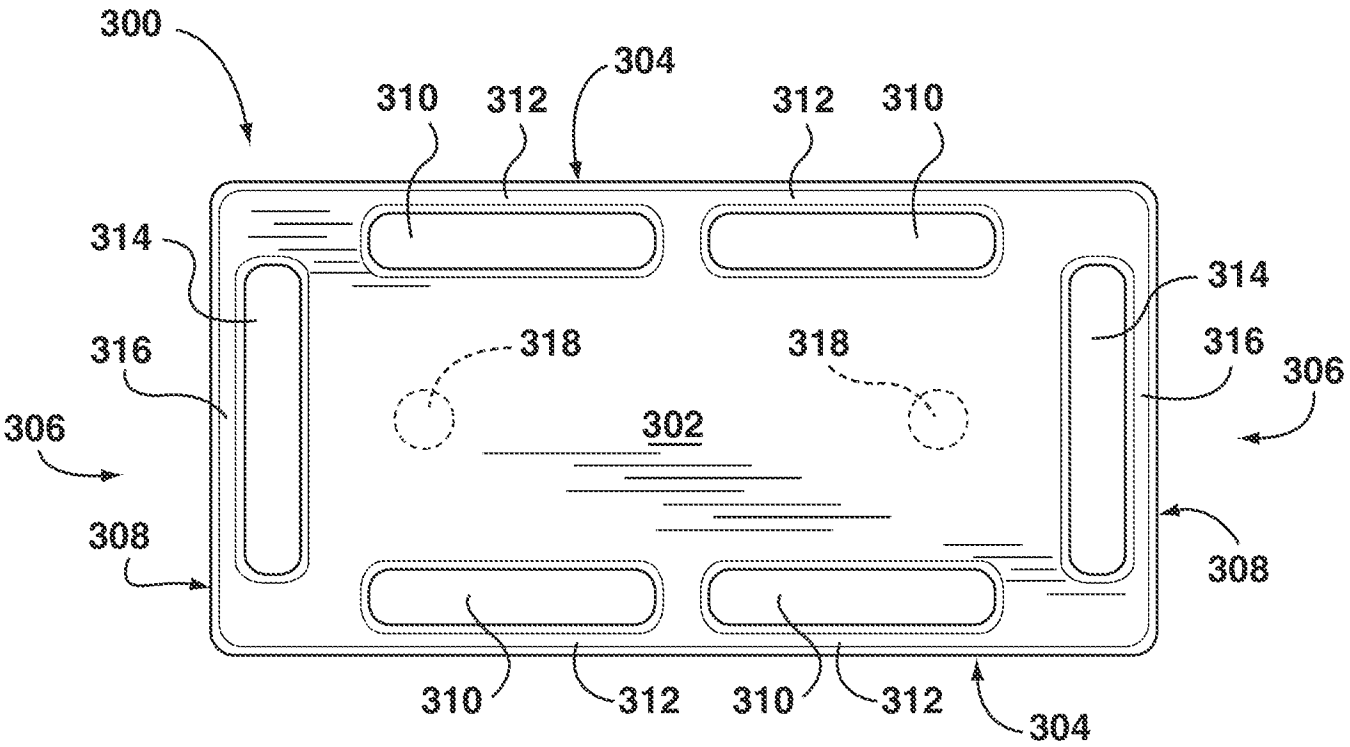
FIG. 3 shows a plan view of a second exemplary exercise weight.
Figure 4:
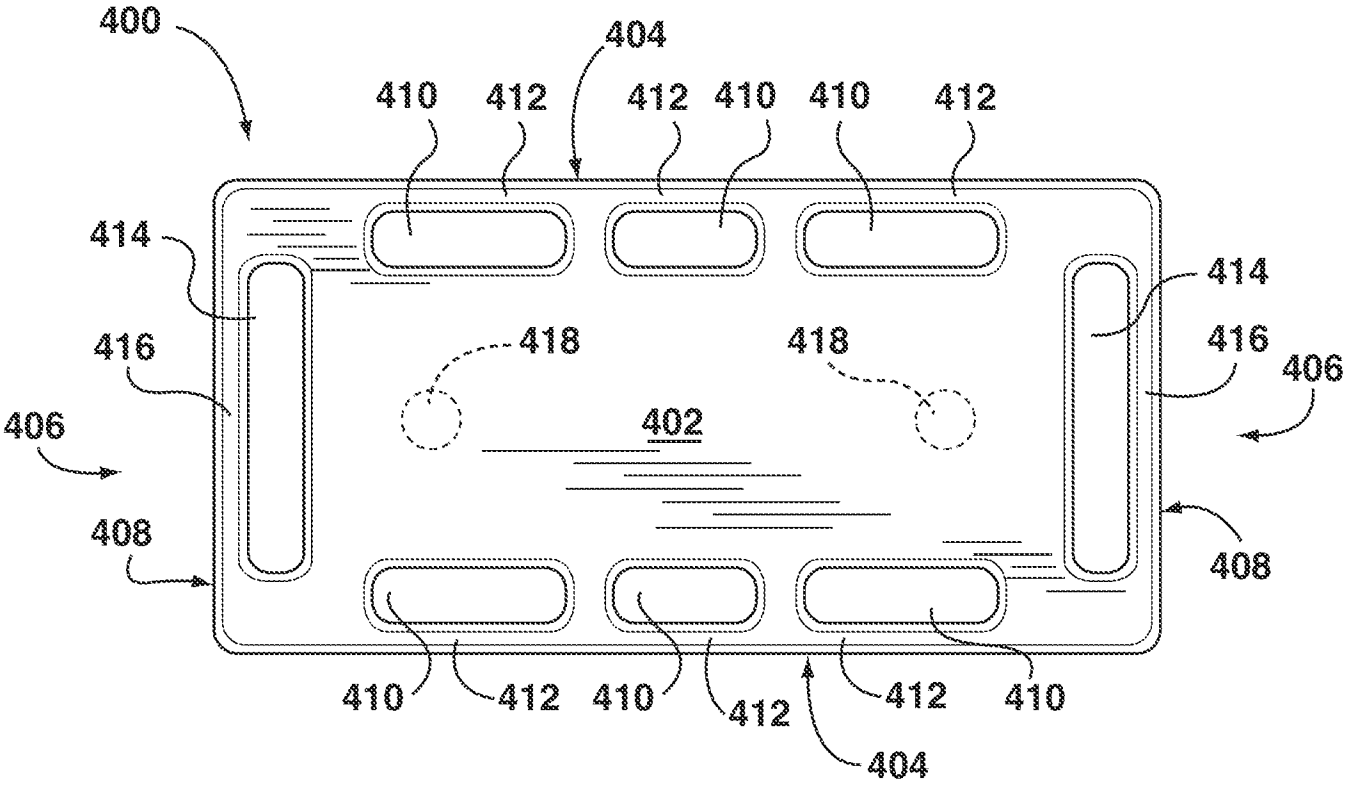
FIG. 4 shows a plan view of a third exemplary exercise weight.

FIG. 3 shows a second exemplary exercise weight 300 which has two pairs of opposed lengthwise grip apertures 310 and FIG. 4 shows a fourth exemplary exercise weight 400 which has three pairs of opposed lengthwise grip apertures 410. Aside from the number and position of the grip apertures, the exemplary exercise weights 300 and 400 shown in FIGS. 3 and 4 are substantially identical to the exemplary exercise weight 100 shown in FIG. 1, with corresponding reference numerals used to refer to corresponding features, except with the prefix "3" or "4" instead of "1". While each of the lengthwise grip apertures in a given pair are preferably of substantially equal length, where the plate includes multiple pairs of lengthwise grip apertures, the lengthwise grip apertures of different pairs of lengthwise grip apertures may be of different lengths. For example, in the exemplary exercise weight 400 shown in FIG. 4, the grip apertures 410 closest to the end edges 408 of the plate 402 are of equal length and are longer than the grip apertures 410 that are centered relative to the length of the plate 402.

Figure 5:
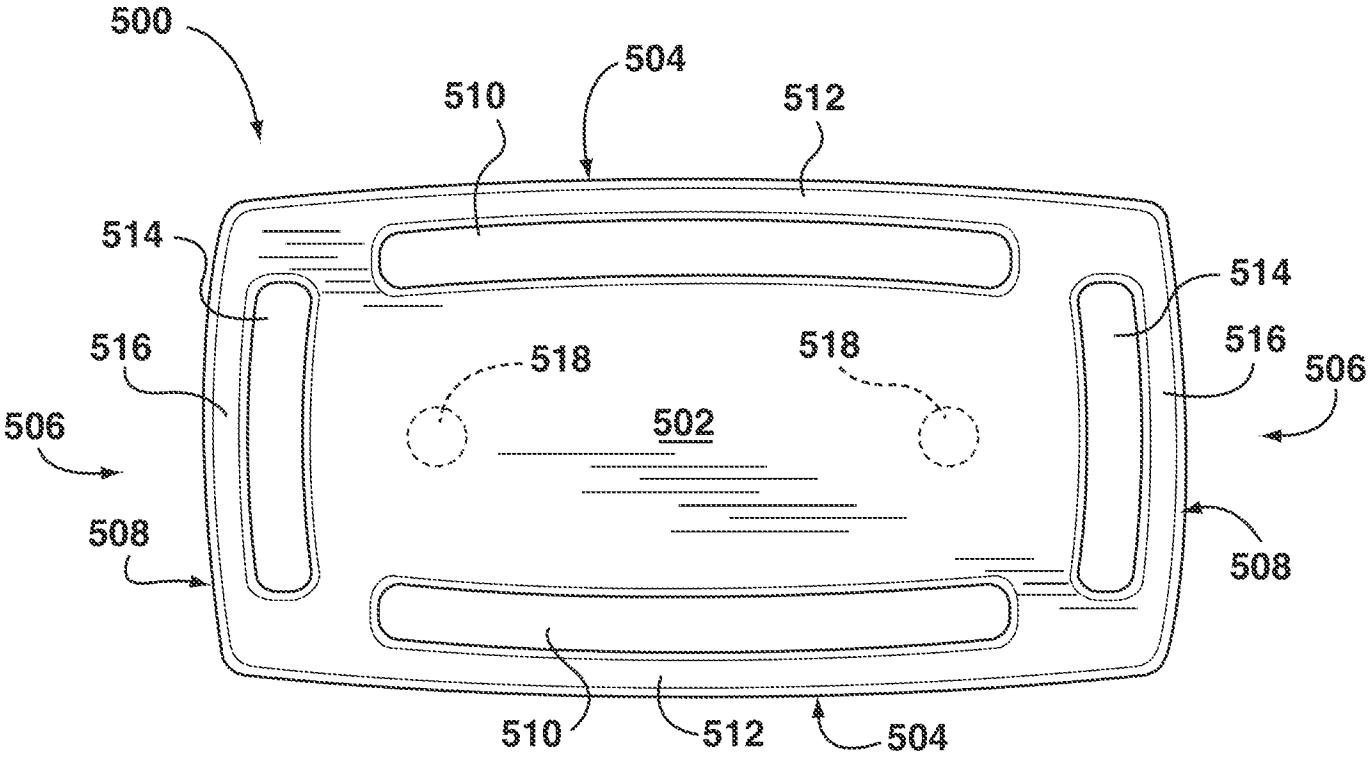
FIG. 5 shows a plan view of a fourth exemplary exercise weight.
Figure 6:
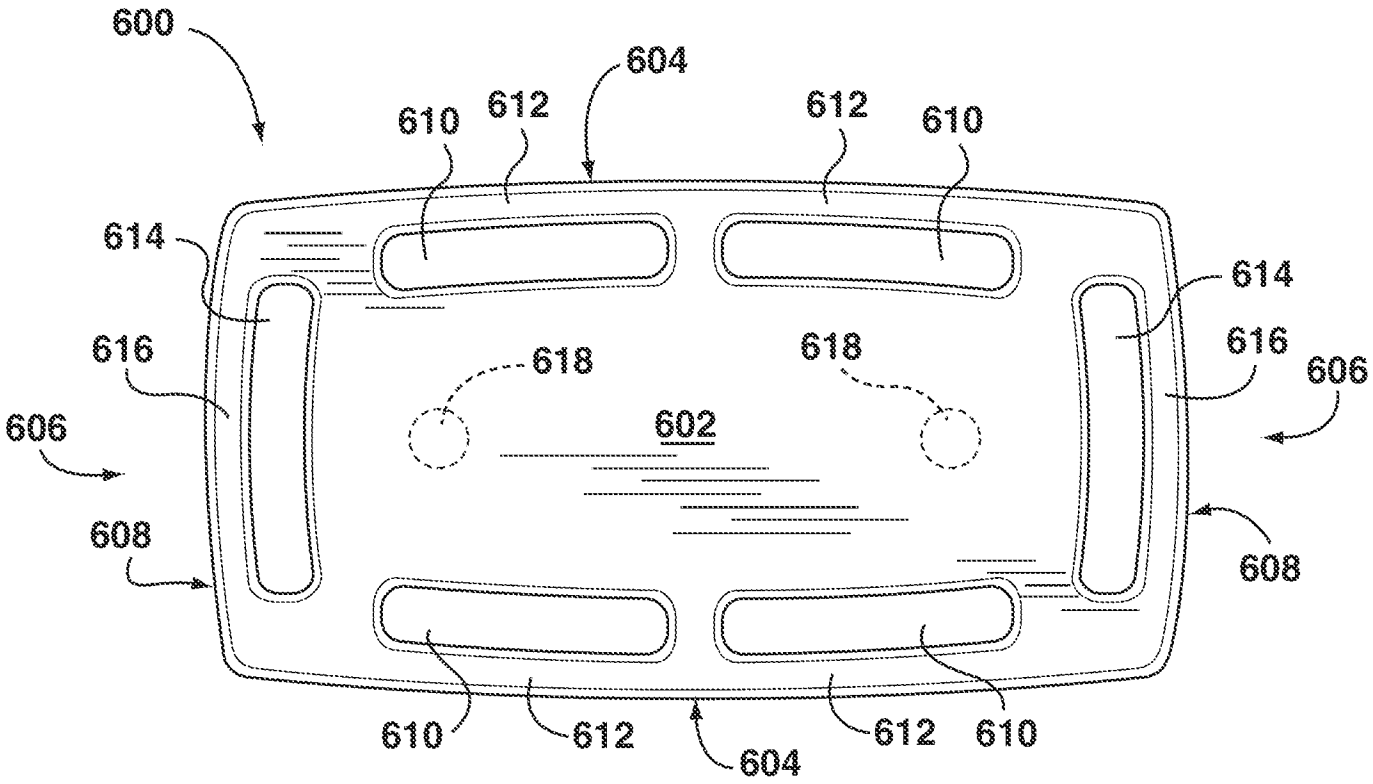
FIG. 6 shows a plan view of a fifth exemplary exercise weight.
Figure 7:
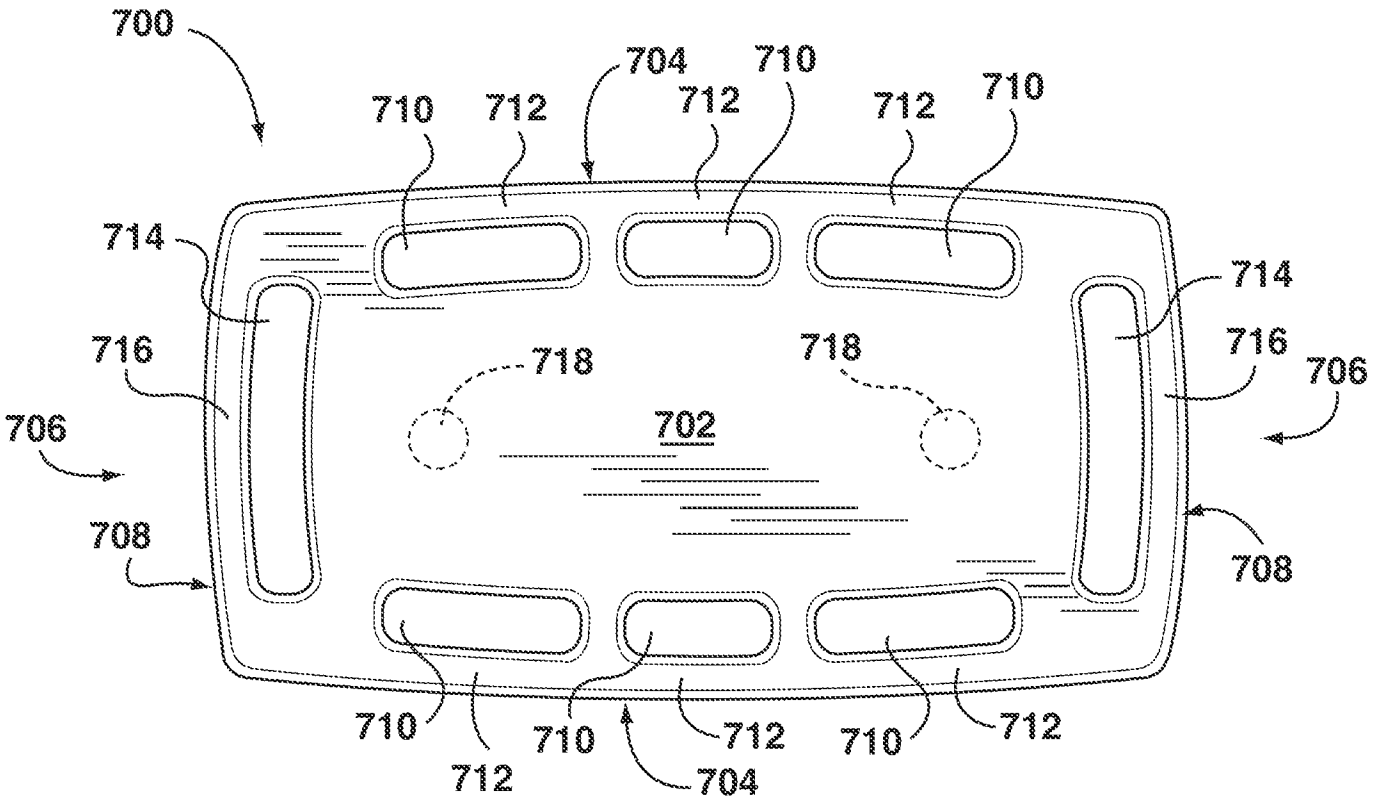
FIG. 7 shows a plan view of a sixth exemplary exercise weight.

FIGS. 5, 6 and 7 show, respectively, exemplary exercise weights 500, 600 and 700 that are similar to the exemplary exercise weights 100, 300 and 400 shown in FIGS. 1 and 2, 3 and 4, respectively, except that the longitudinal edges 504, 604, 704, lengthwise grip apertures 510, 610, 710, end edges 508, 608, 708 and end grip apertures 514, 614 and 714 all have a slightly convex curvature. Corresponding reference numerals are used to refer to corresponding features, except with the prefix "5", "6" or "7" instead of "1", "3" or "4".

Figure 8:
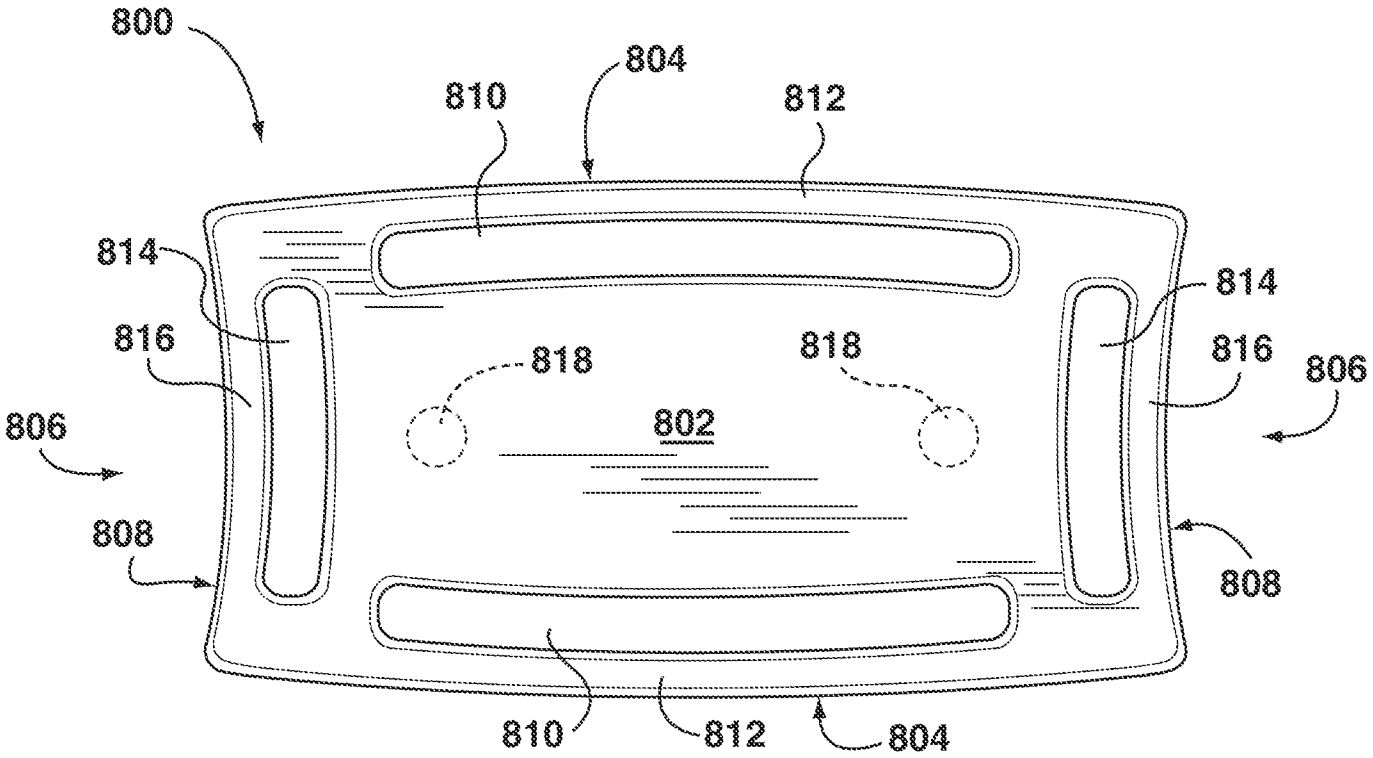
FIG. 8 shows a plan view of a seventh exemplary exercise weight.
Figure 9:
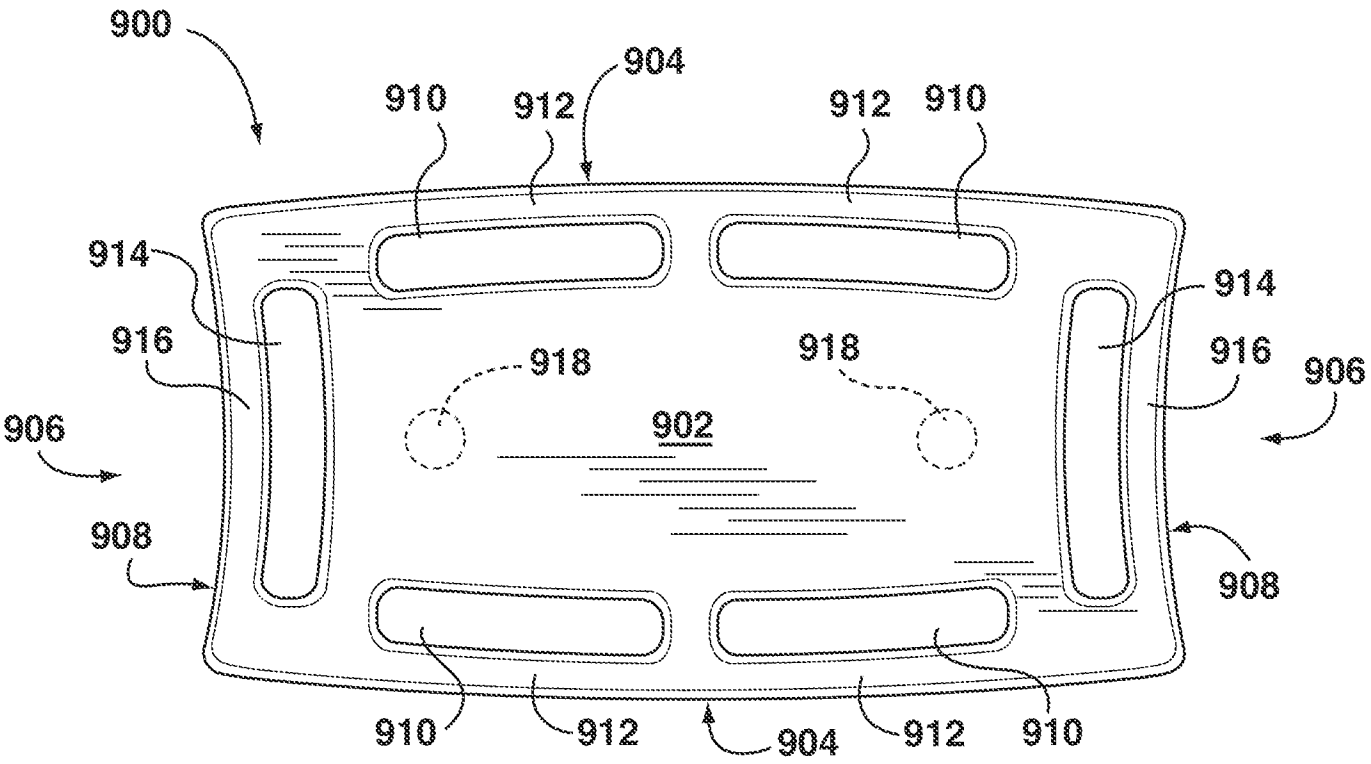
FIG. 9 shows a plan view of an eighth exemplary exercise weight.
Figure 10:
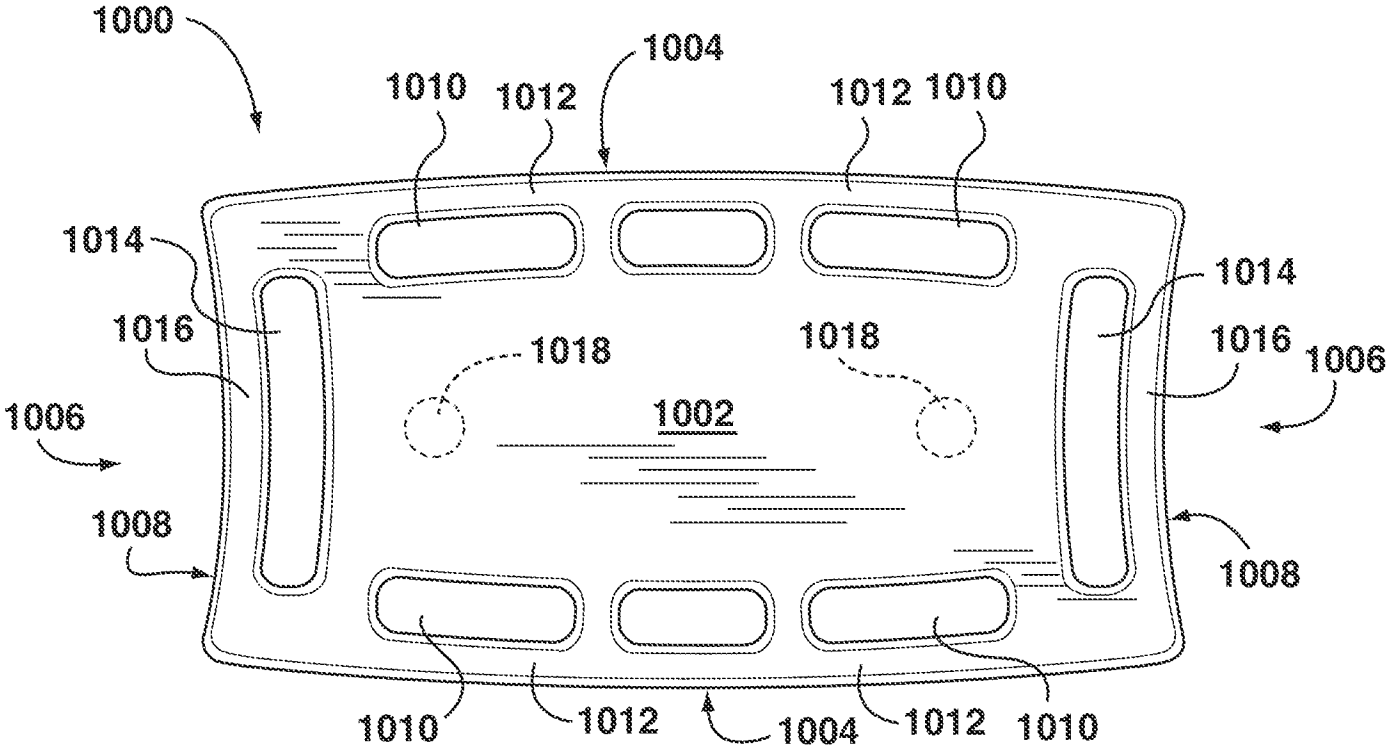
FIG. 10 shows a plan view of a ninth exemplary exercise weight.

Reference is now made to FIGS. 8, 9 and 10, which show, respectively, exemplary exercise weights 800, 900 and 1000 that are similar to the exemplary exercise weights 100, 300 and 400 shown in FIGS. 1 and 2, 3 and 4, respectively, except that the longitudinal edges 804, 904, 1004 and lengthwise grip apertures 810, 910, 1010 have a slightly convex curvature and the end edges 808, 908, 1008 and end grip apertures 814, 914 and 1014 have a slightly concave curvature. Corresponding reference numerals are used to refer to corresponding features, except with the prefix "8", "9" or "10" instead of "1", "3" or "4".

Figure 11:
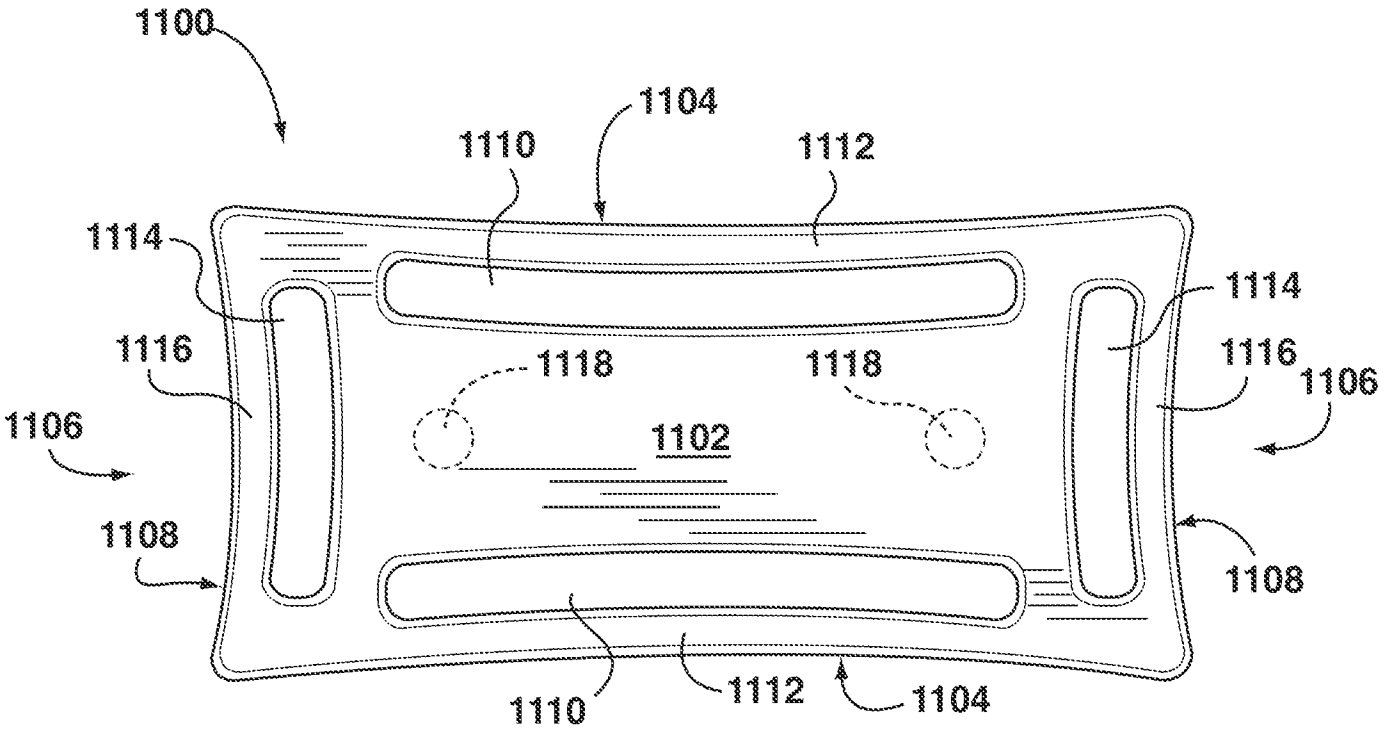
FIG. 11 shows a plan view of a tenth exemplary exercise weight.
Figure 12:
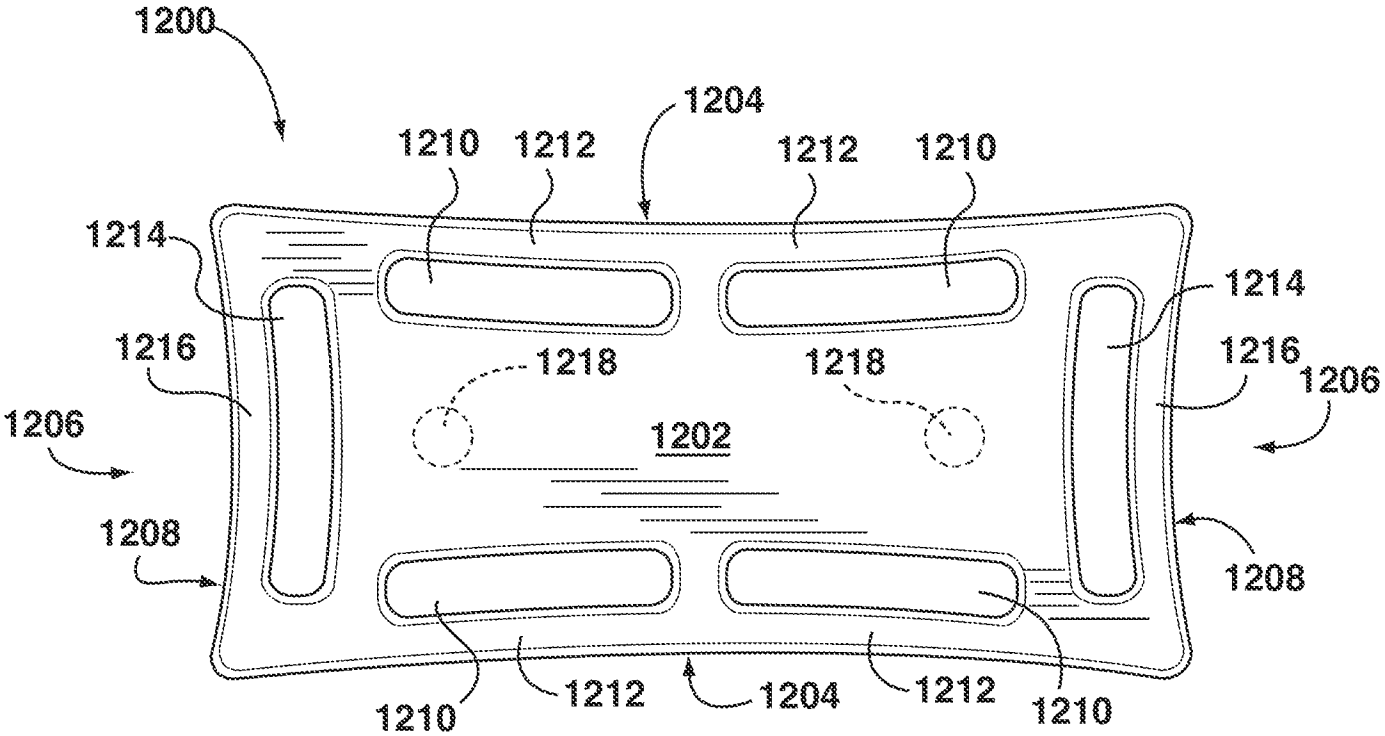
FIG. 12 shows a plan view of a eleventh exemplary exercise weight.
Figure 13:
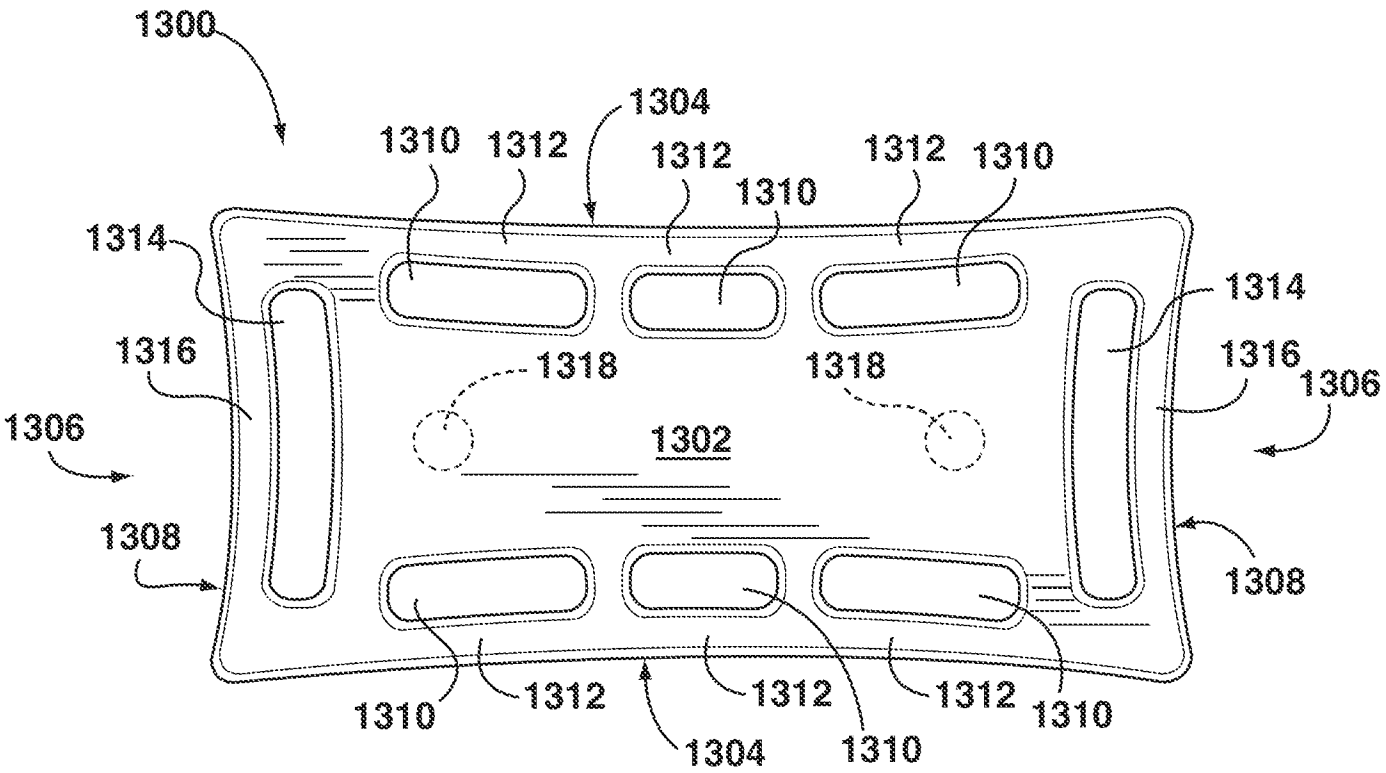
FIG. 13 shows a plan view of a twelfth exemplary exercise weight.

FIGS. 11, 12 and 13 show, respectively, exemplary exercise weights 1100, 1200 and 1300 that are similar to the exemplary exercise weights 100, 300 and 400 shown in FIGS. 1 and 2, 3 and 4, respectively, except that the longitudinal edges 1104, 1204, 1304, lengthwise grip apertures 1110, 1210, 1310, end edges 1108, 1208, 1308 and end grip apertures 1114, 1214 and 1314 all have a slightly concave curvature. Corresponding reference numerals are used to refer to corresponding features, except with the prefix "11", "12" or "13" instead of "1", "3" or "4".

Figure 14:
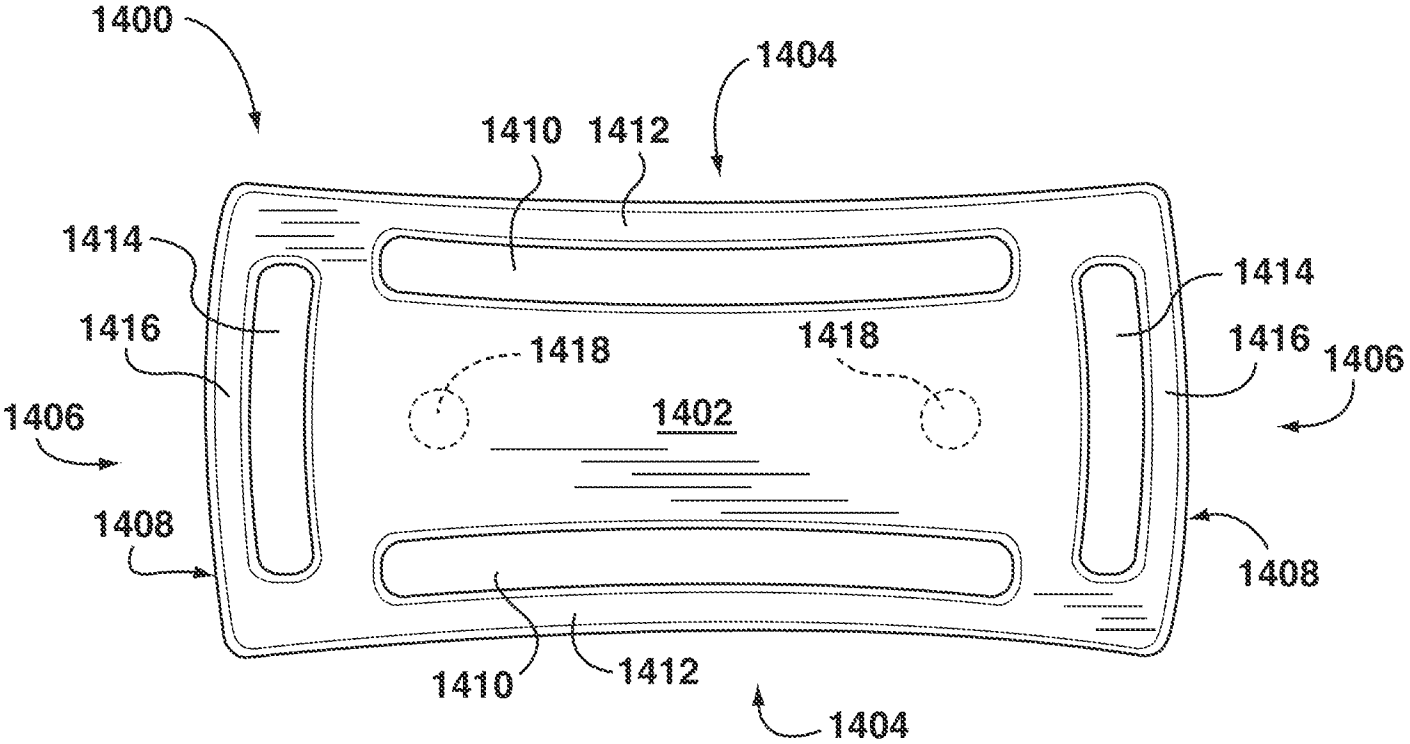
FIG. 14 shows a plan view of a thirteenth exemplary exercise weight.
Figure 15:
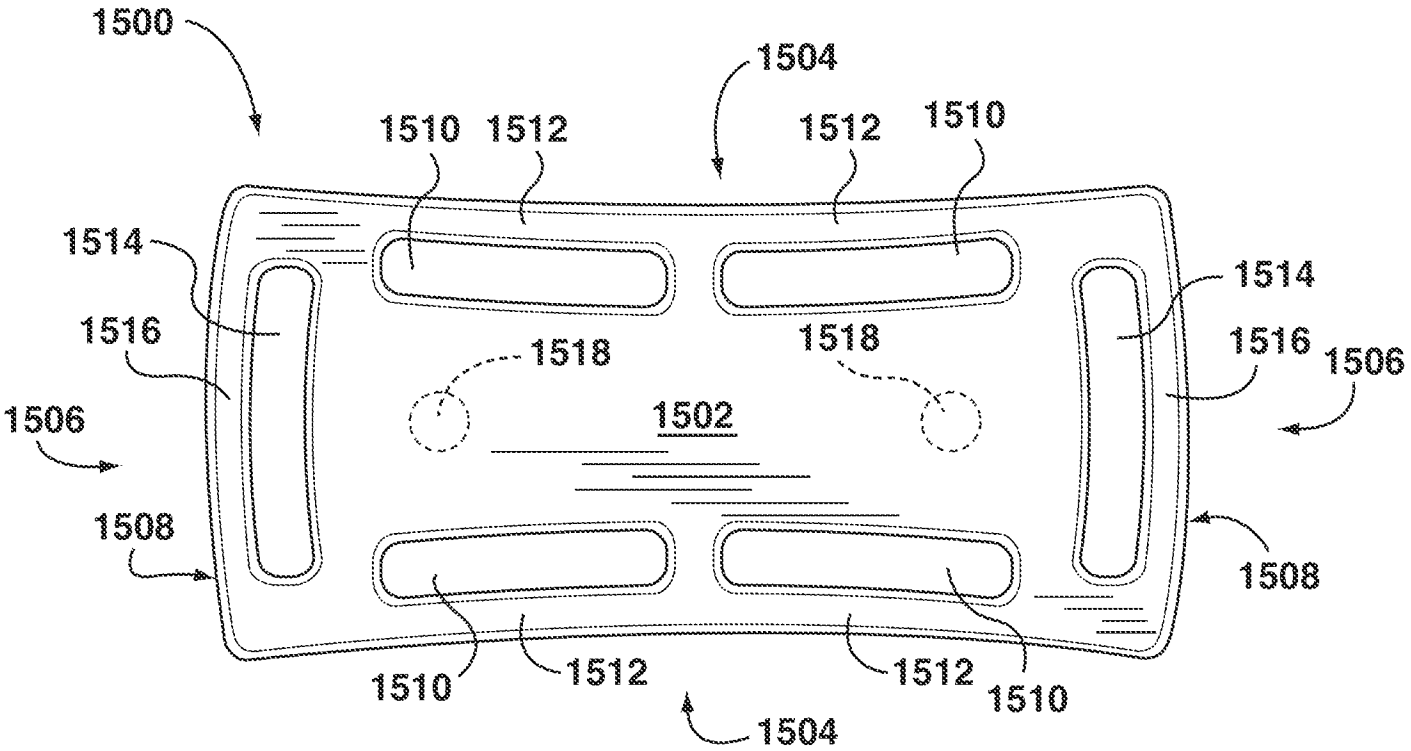
FIG. 15 shows a plan view of a fourteenth exemplary exercise weight.
Figure 16:
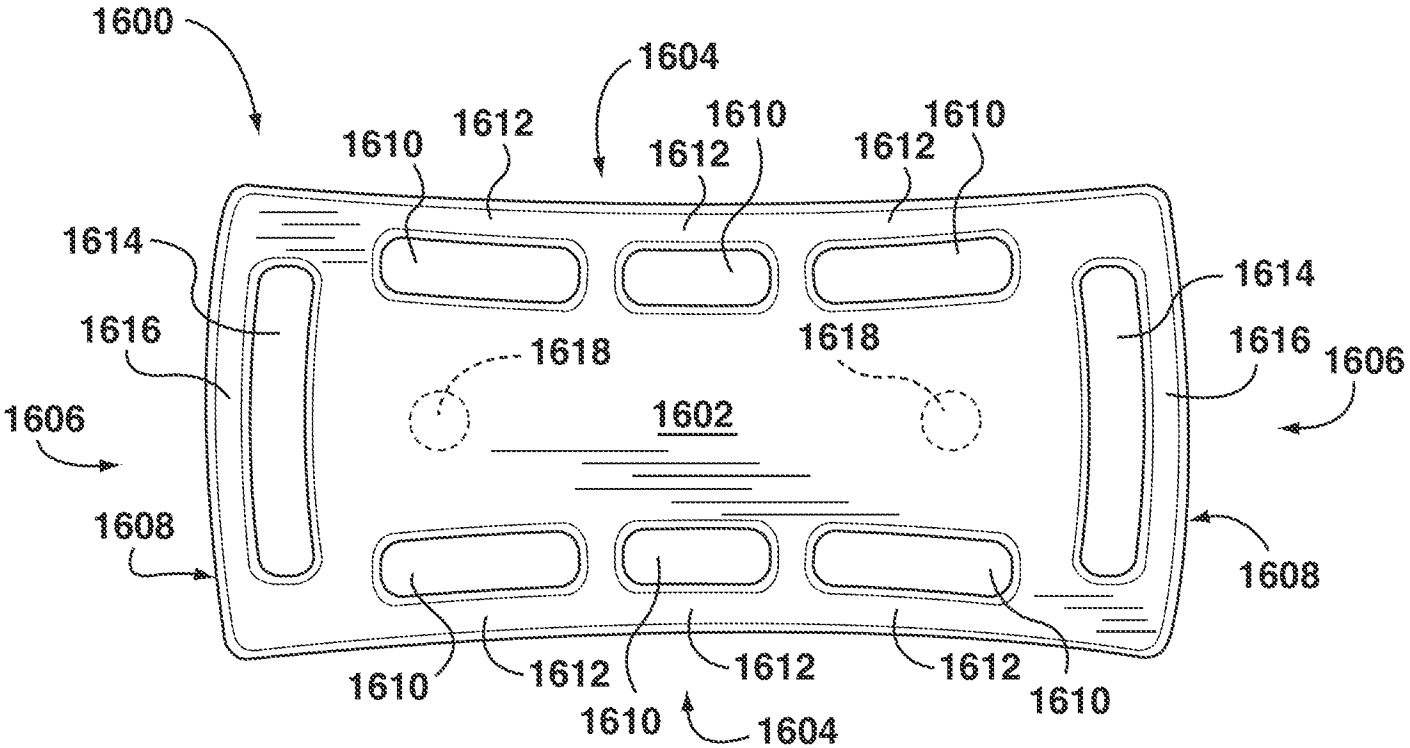
FIG. 16 shows a plan view of a fifteenth exemplary exercise weight.

Reference is now made to FIGS. 14, 15 and 16, which show, respectively, exemplary exercise weights 1400, 1500 and 1600 that are similar to the exemplary exercise weights 100, 300 and 400 shown in FIGS. 1 and 2, 3 and 4, respectively, except that the longitudinal edges 1404, 1504, 1604 and lengthwise grip apertures 1410, 1510, 1610 have a slightly concave curvature and the end edges 1408, 1508, 1608 and end grip apertures 1414, 1514 and 1614 have a slightly convex curvature. Corresponding reference numerals are used to refer to corresponding features, except with the prefix "14", "15" or "16" instead of "1", "3" or "4".

Figure 17:
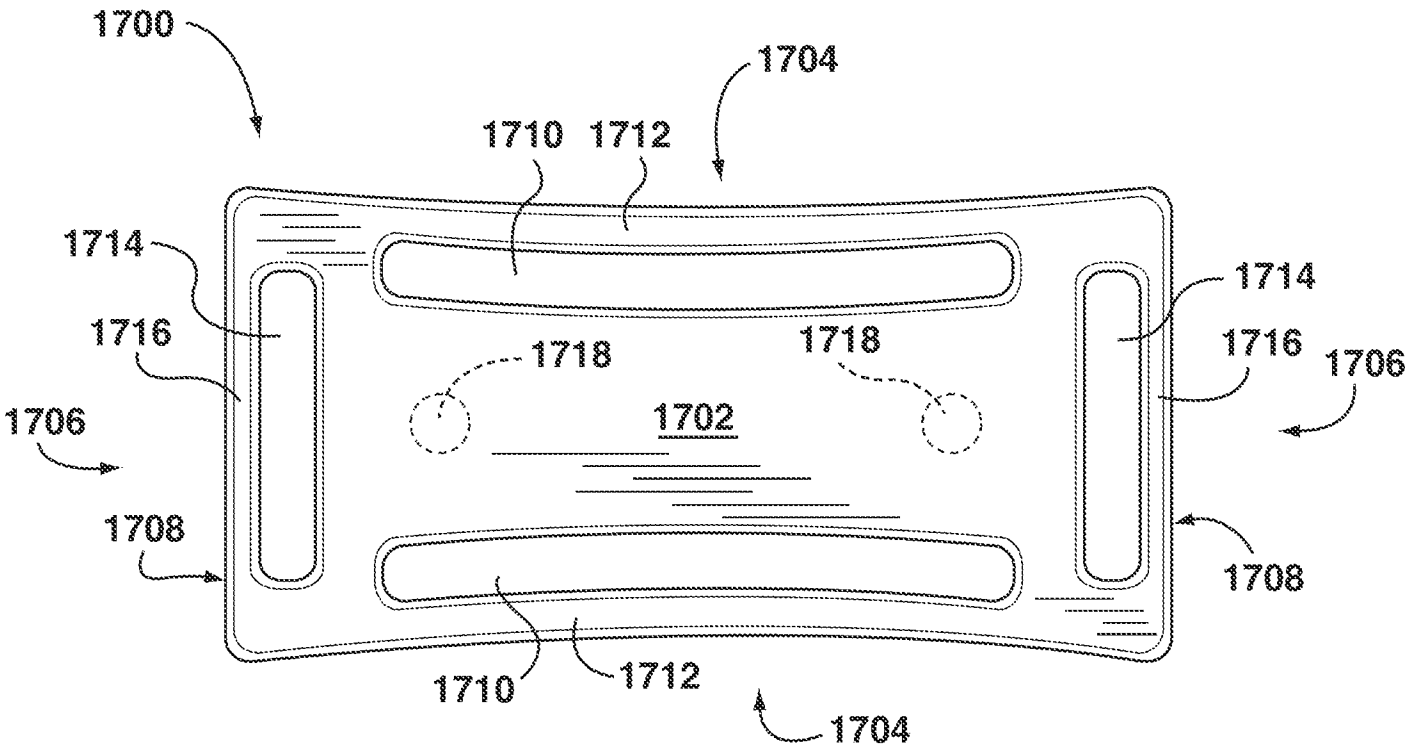
FIG. 17 shows a plan view of a sixteenth exemplary exercise weight.
Figure 18:
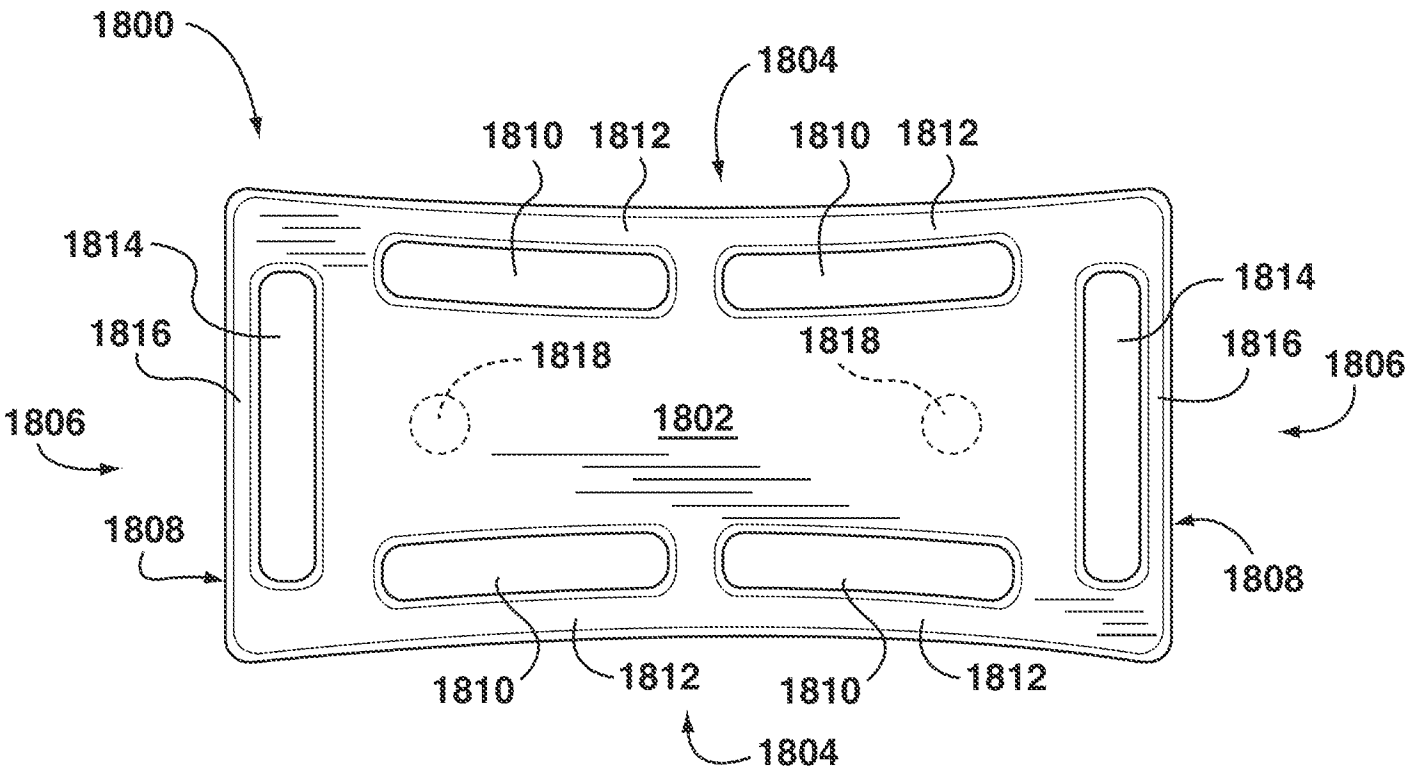
FIG. 18 shows a plan view of a seventeenth exemplary exercise weight.
Figure 19:
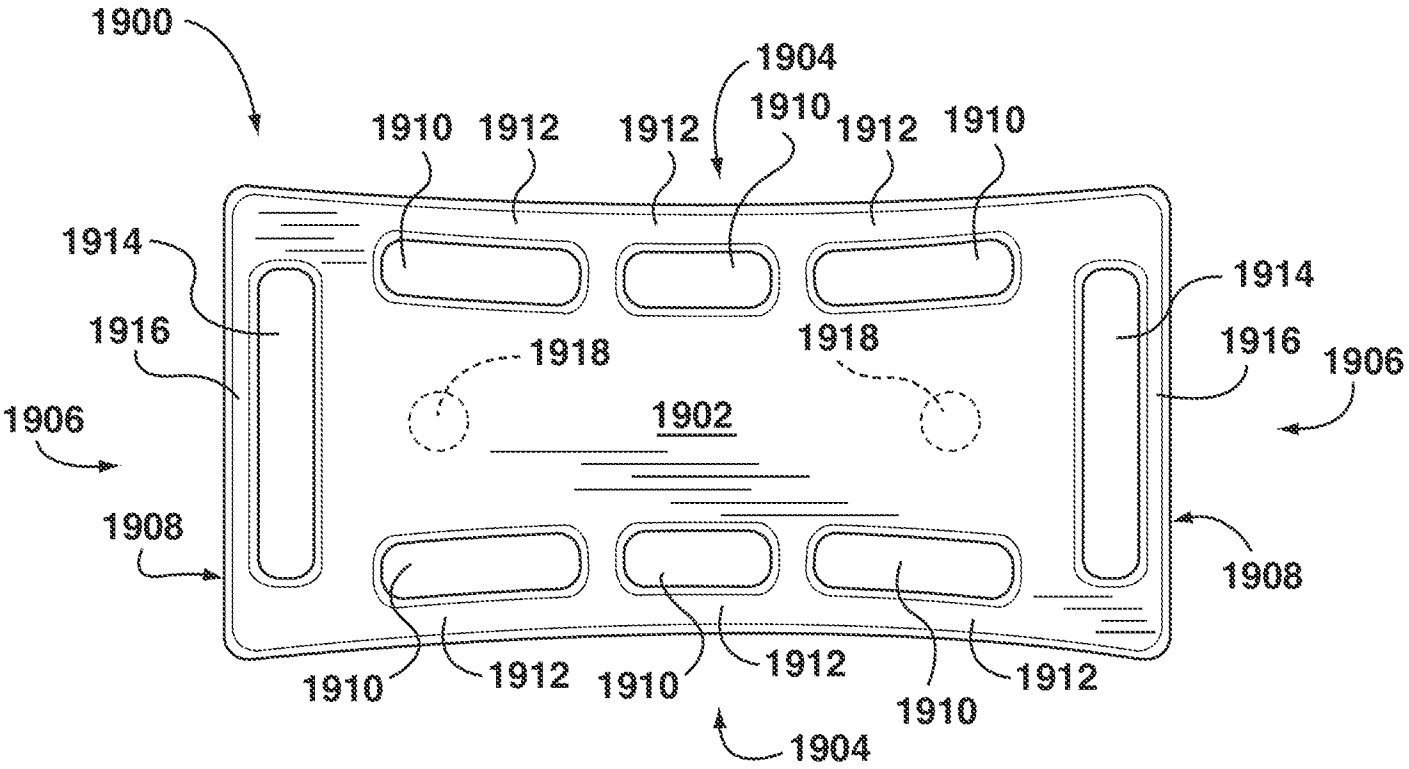
FIG. 19 shows a plan view of a eighteenth exemplary exercise weight.

FIGS. 17, 18 and 19 show, respectively, exemplary exercise weights 1700, 1800 and 1900 that are similar to the exemplary exercise weights 100, 300 and 400 shown in FIGS. 1 and 2, 3 and 4, respectively, except that the longitudinal edges 1704, 1804, 1904 and lengthwise grip apertures 1710, 1810, 1910 have a slightly concave curvature, and corresponding reference numerals are used to refer to corresponding features, except with the prefix "17", "18" or "19".

Figure 20:
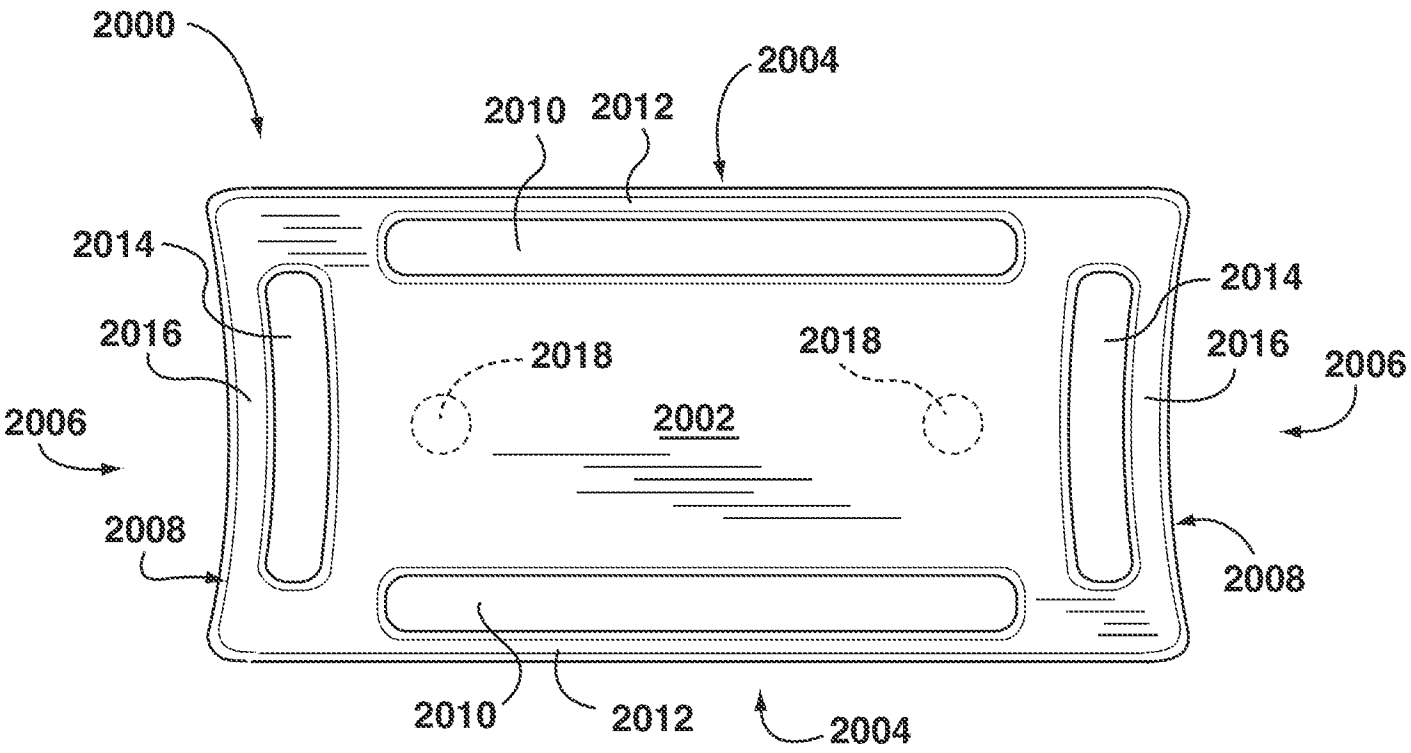
FIG. 20 shows a plan view of a nineteenth exemplary exercise weight.
Figure 21:
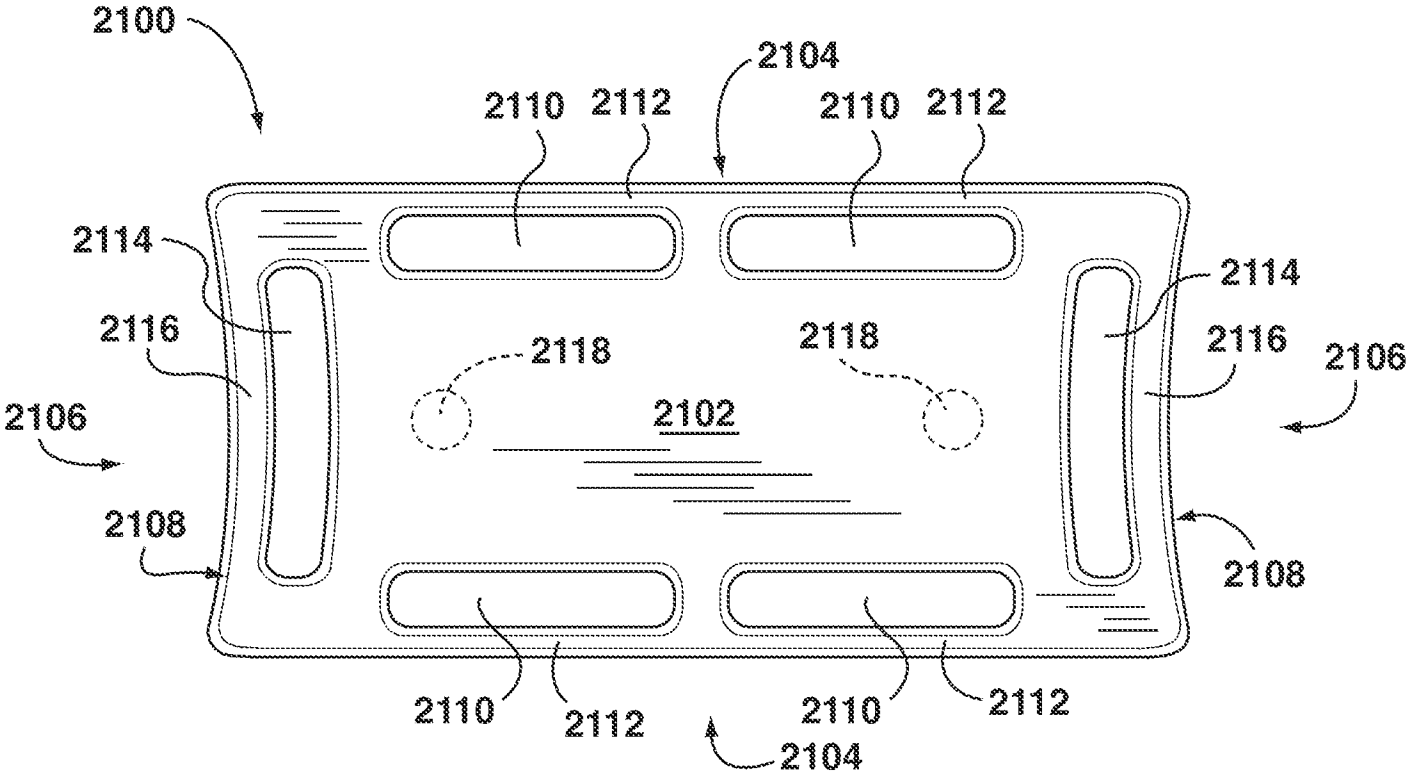
FIG. 21 shows a plan view of a twentieth exemplary exercise weight.
Figure 22:
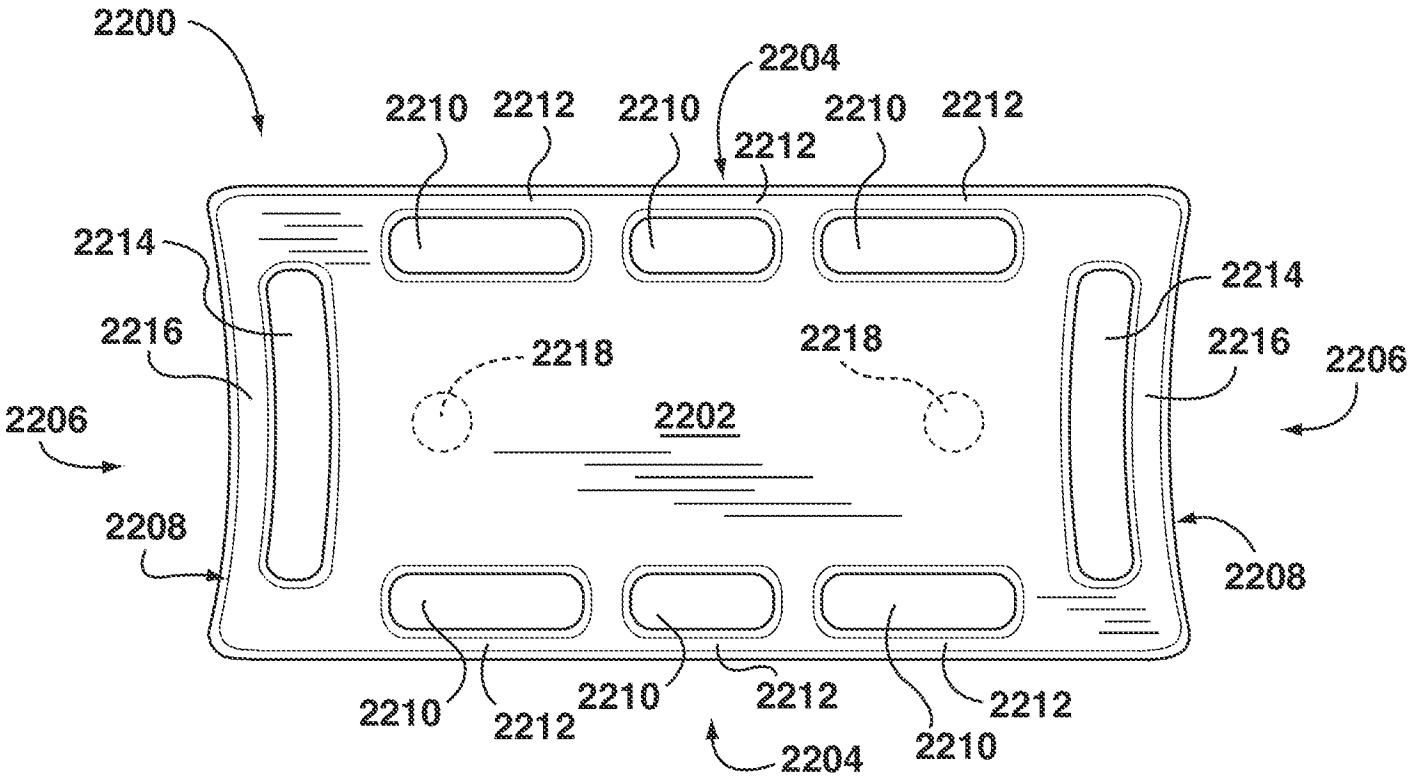
FIG. 22 shows a plan view of a twenty-first exemplary exercise weight.

Reference is now made to FIGS. 20, 21 and 22, which show, respectively, exemplary exercise weights 2000, 2100 and 2200 that are similar to the exemplary exercise weights 100, 300 and 400 shown in FIGS. 1 and 2, 3 and 4, respectively, except that the end edges 2008, 2108, 2208 and end grip apertures 2014, 2114 and 2214 have a slightly concave curvature, and corresponding reference numerals are used to refer to corresponding features, except with the prefix "20", "21" or "22".

Figure 23:
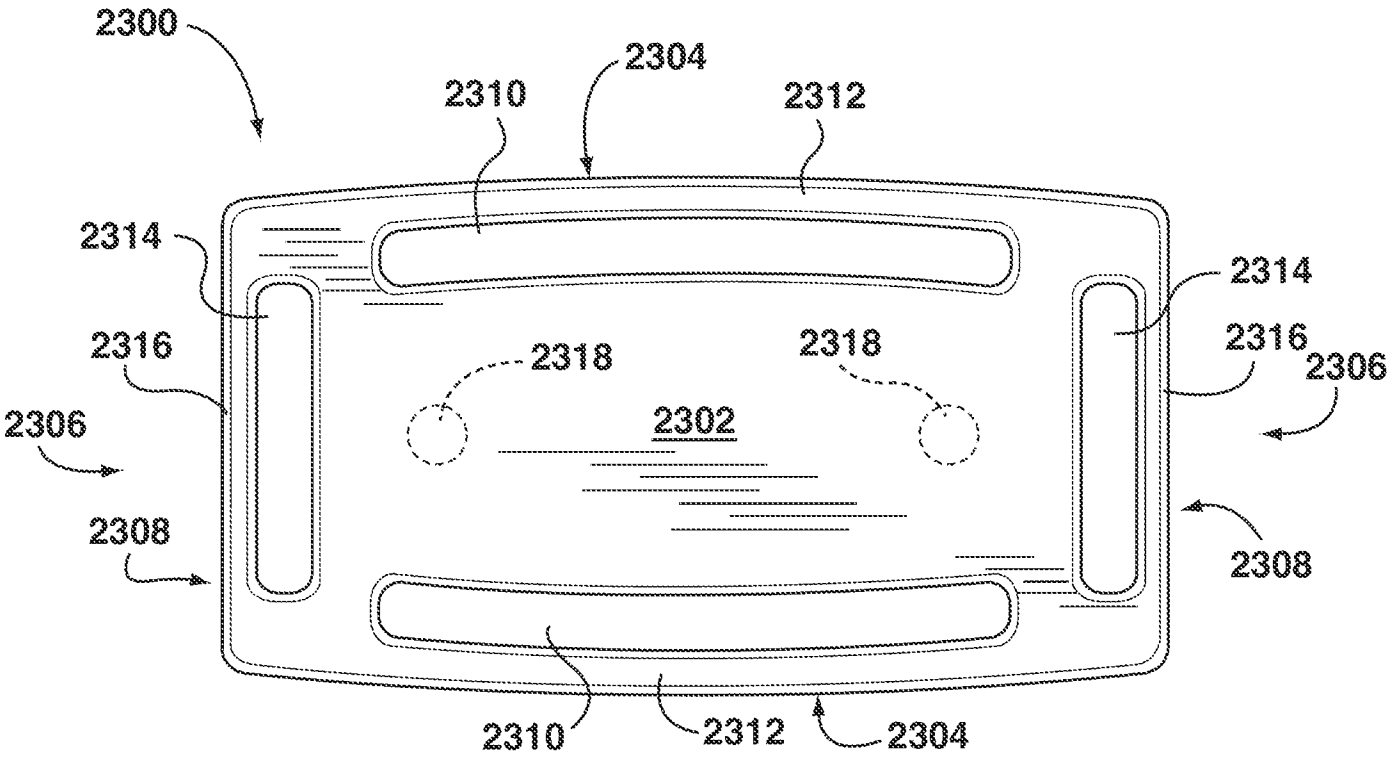
FIG. 23 shows a plan view of a twenty-second exemplary exercise weight.
Figure 24:
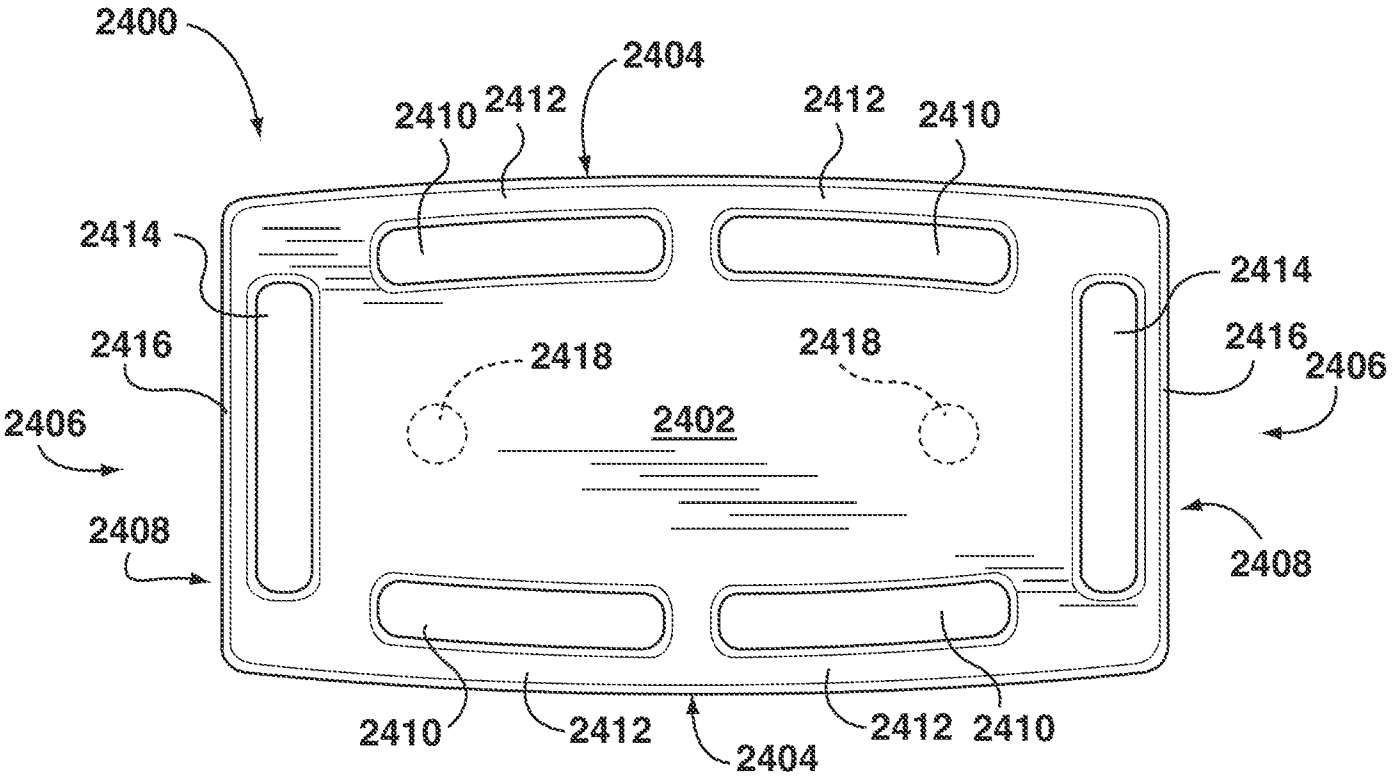
FIG. 24 shows a plan view of a twenty-third exemplary exercise weight.
Figure 25:
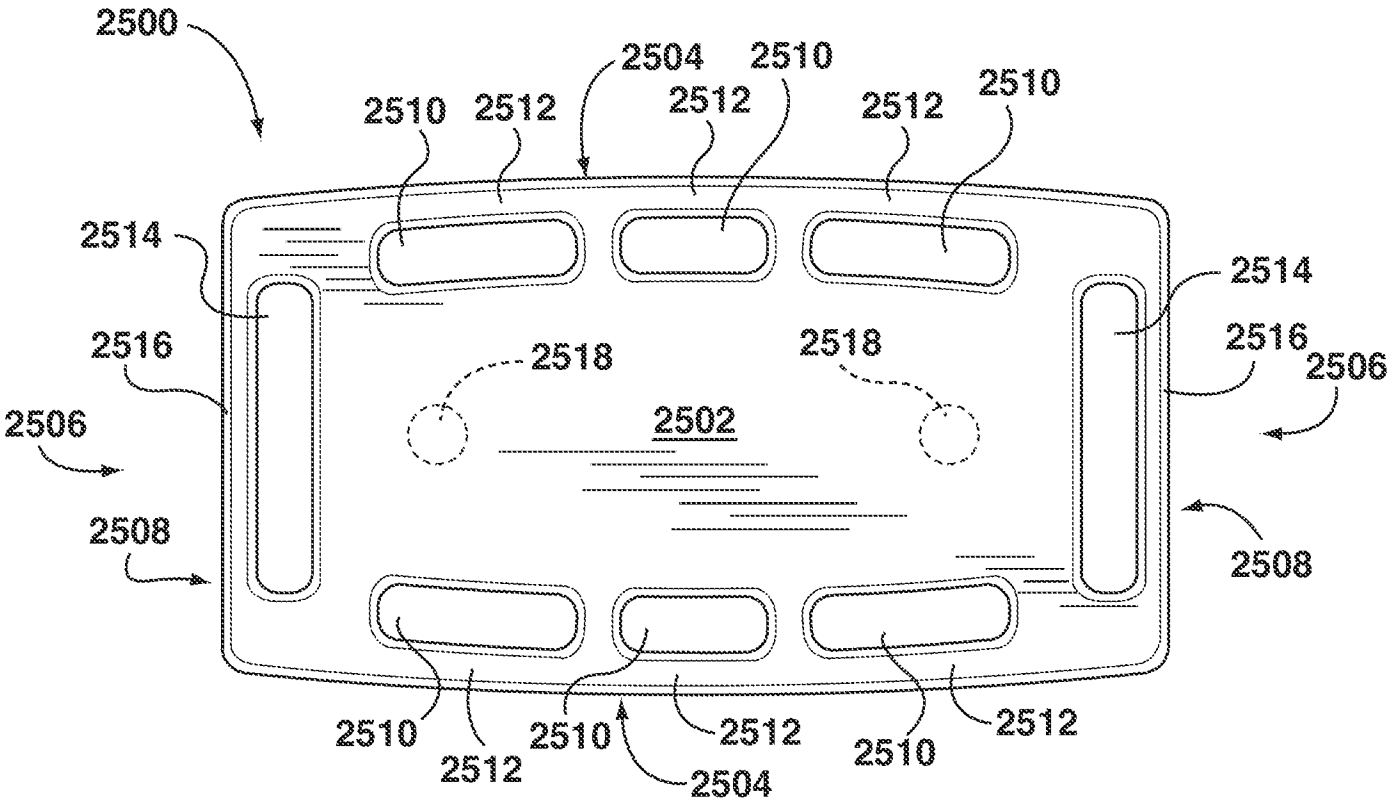
FIG. 25 shows a plan view of a twenty-fourth exemplary exercise weight.

FIGS. 23, 24 and 25 show, respectively, exemplary exercise weights 2300, 2400 and 2500 that are similar to the exemplary exercise weights 100, 300 and 400 shown in FIGS. 1 and 2, 3 and 4, respectively, except that the longitudinal edges 2304, 2404, 2504 and lengthwise grip apertures 2310, 2410, 2510 have a slightly convex curvature, and corresponding reference numerals are used to refer to corresponding features, except with the prefix "23", "24" or "25".

Figure 26:
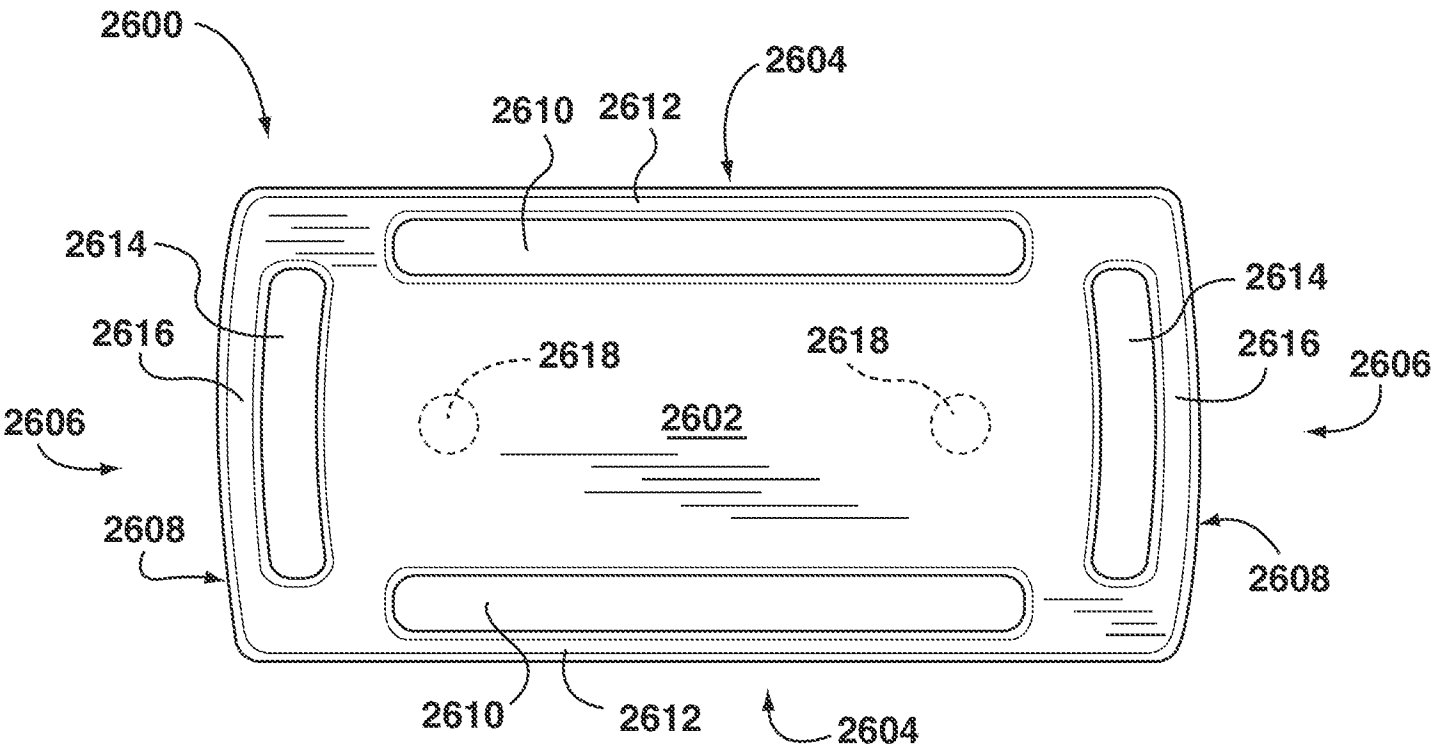
FIG. 26 shows a plan view of a twenty-fifth exemplary exercise weight.
Figure 27:
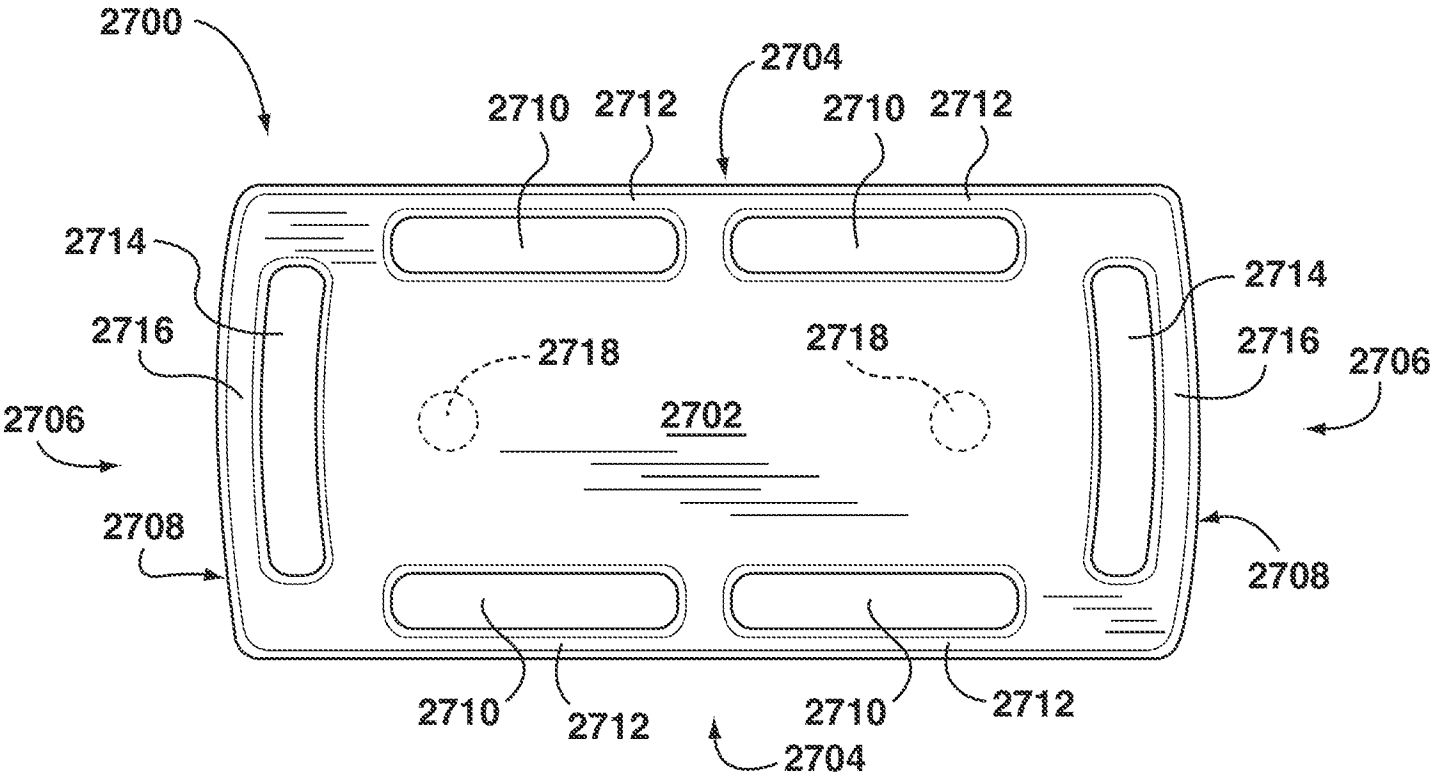
FIG. 27 shows a plan view of a twenty-sixth exemplary exercise weight.
Figure 28:
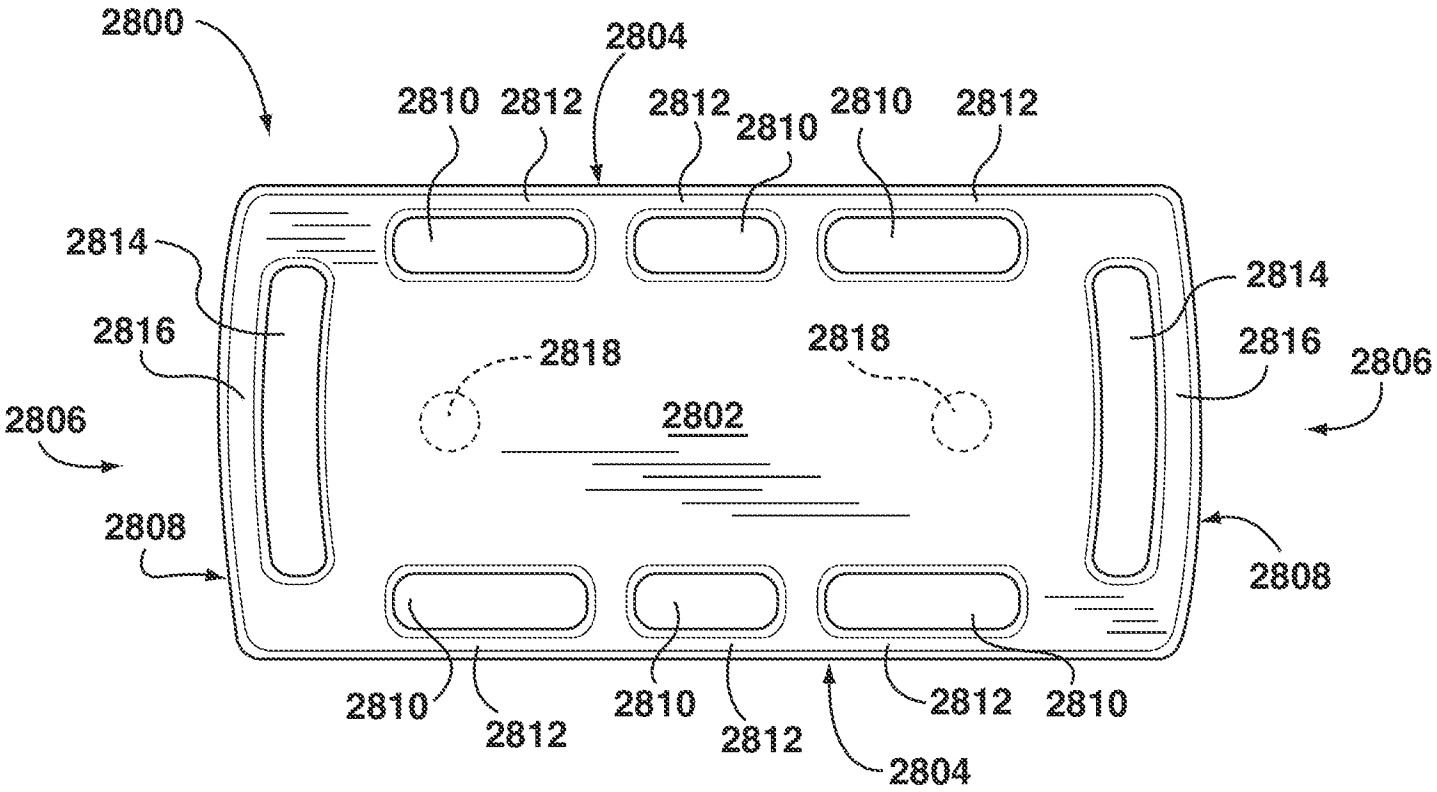
FIG. 28 shows a plan view of a twenty-seventh exemplary exercise weight.

Reference is now made to FIGS. 26, 27 and 28, which show, respectively, exemplary exercise weights 2600, 2700 and 2800 that are similar to the exemplary exercise weights 100, 300 and 400 shown in FIGS. 1 and 2, 3 and 4, respectively, except that the end edges 2608, 2708, 2808 and end grip apertures 2614, 2714 and 2814 have a slightly convex curvature, and corresponding reference numerals are used to refer to corresponding features, except with the prefix "20", "21" or "22".

As shown in the exemplary illustrated embodiments, where the longitudinal edges and end edges of the plate are substantially linear, the lengthwise grip apertures and the end grip apertures are also preferably straight, and where one or both of the longitudinal edges and/or the end edges are curved, the respective lengthwise grip aperture(s) and/or end grip apertures will preferably have a corresponding curvature.

Figure 29:
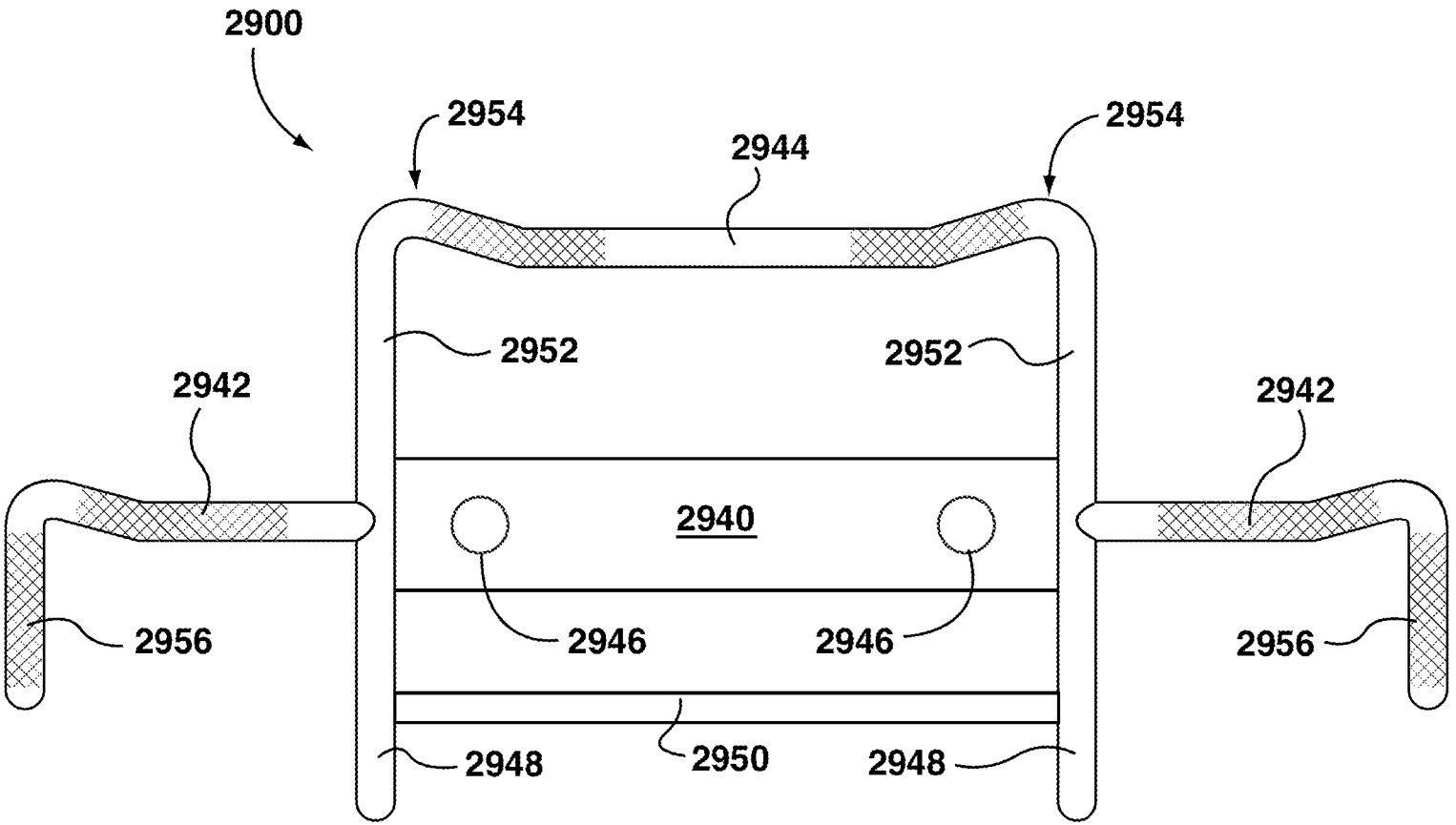
FIG. 29 shows a plan view of an exemplary barbell.
Figure 30:
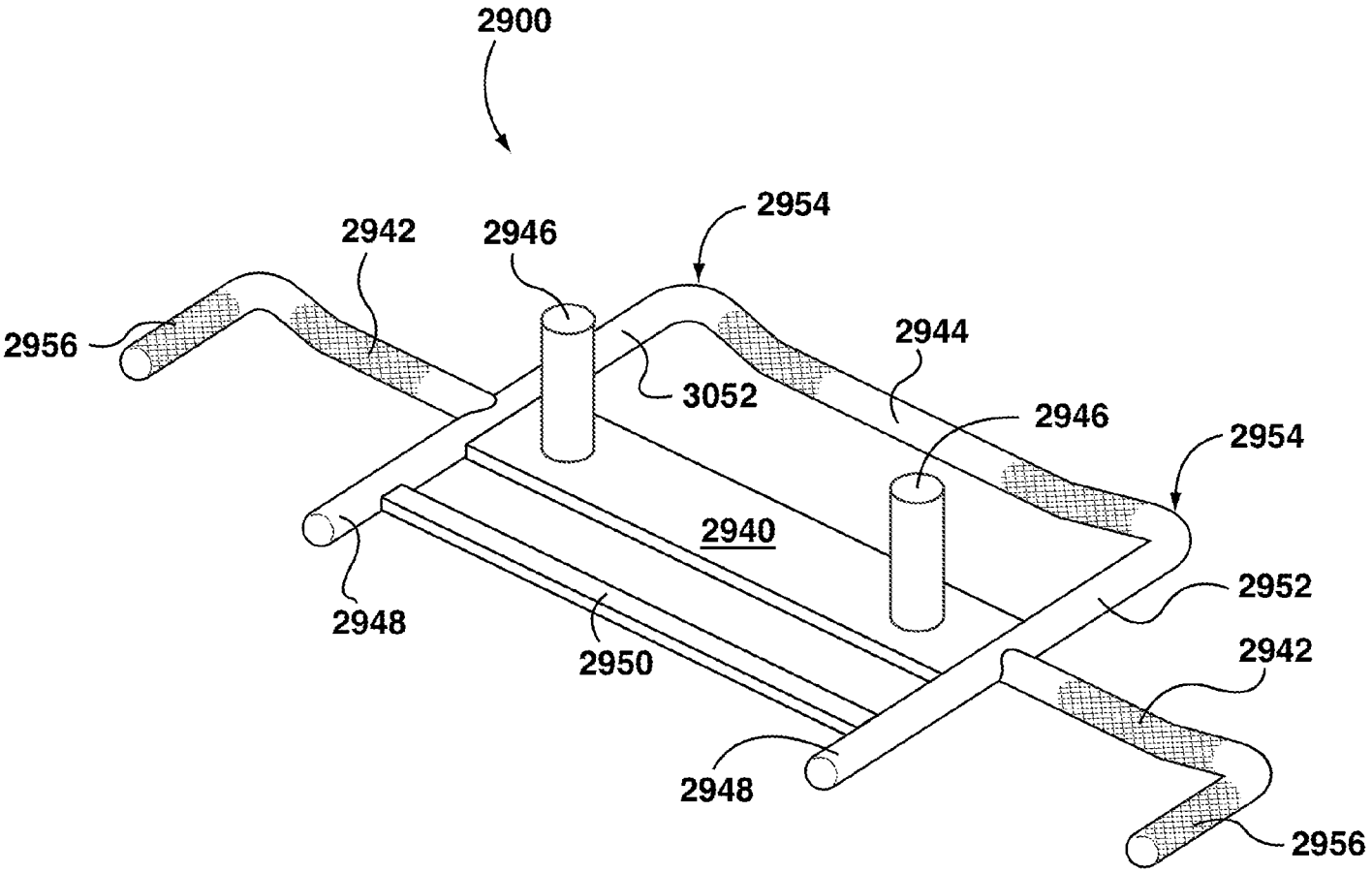
FIG. 30 shows a perspective view of the exemplary barbell of FIG. 29.
Figure 31:
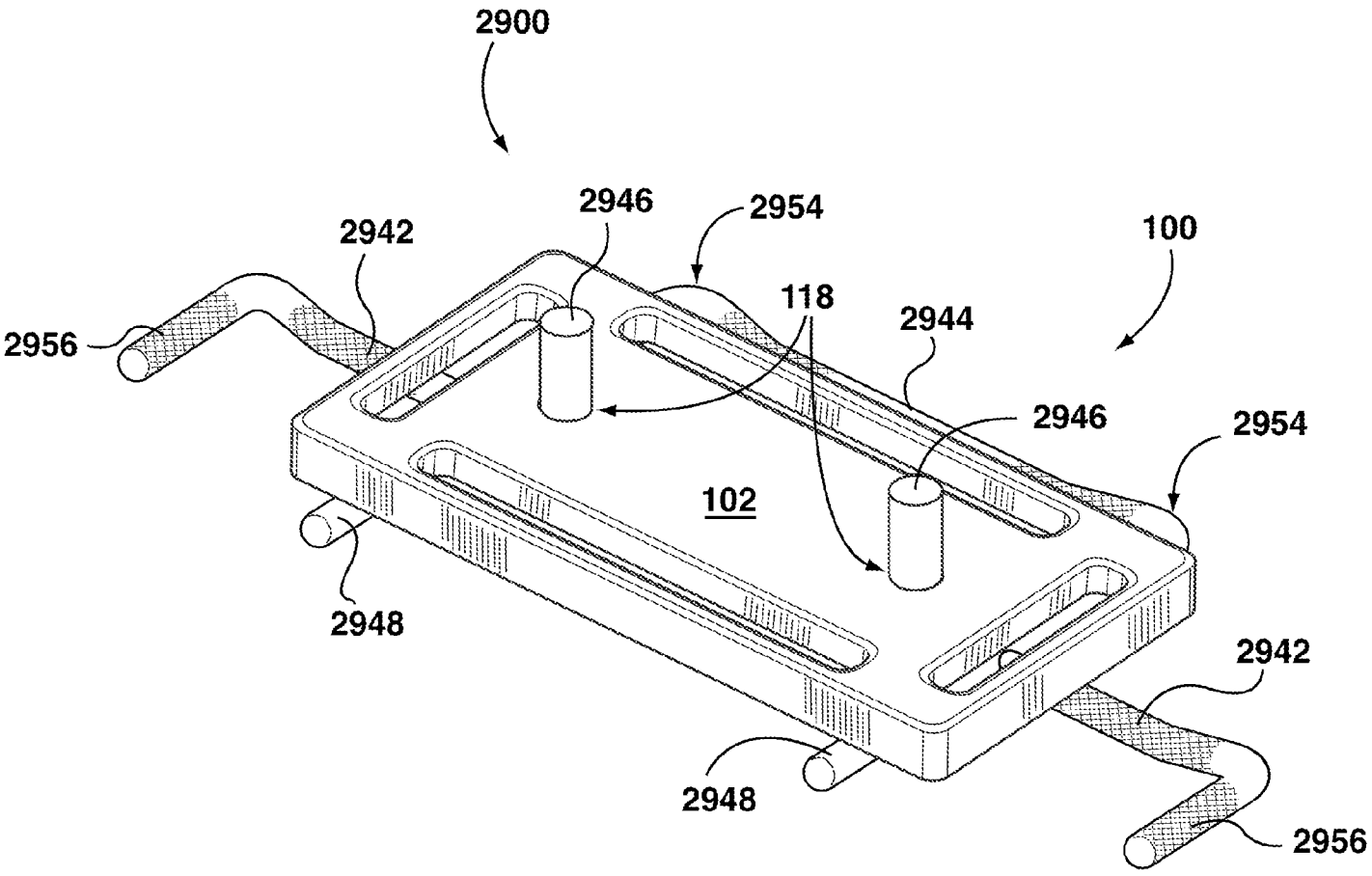
FIG. 31 is a perspective view showing the exemplary exercise weight of FIG. 1 on the barbell of FIG. 29.
Figure 32:
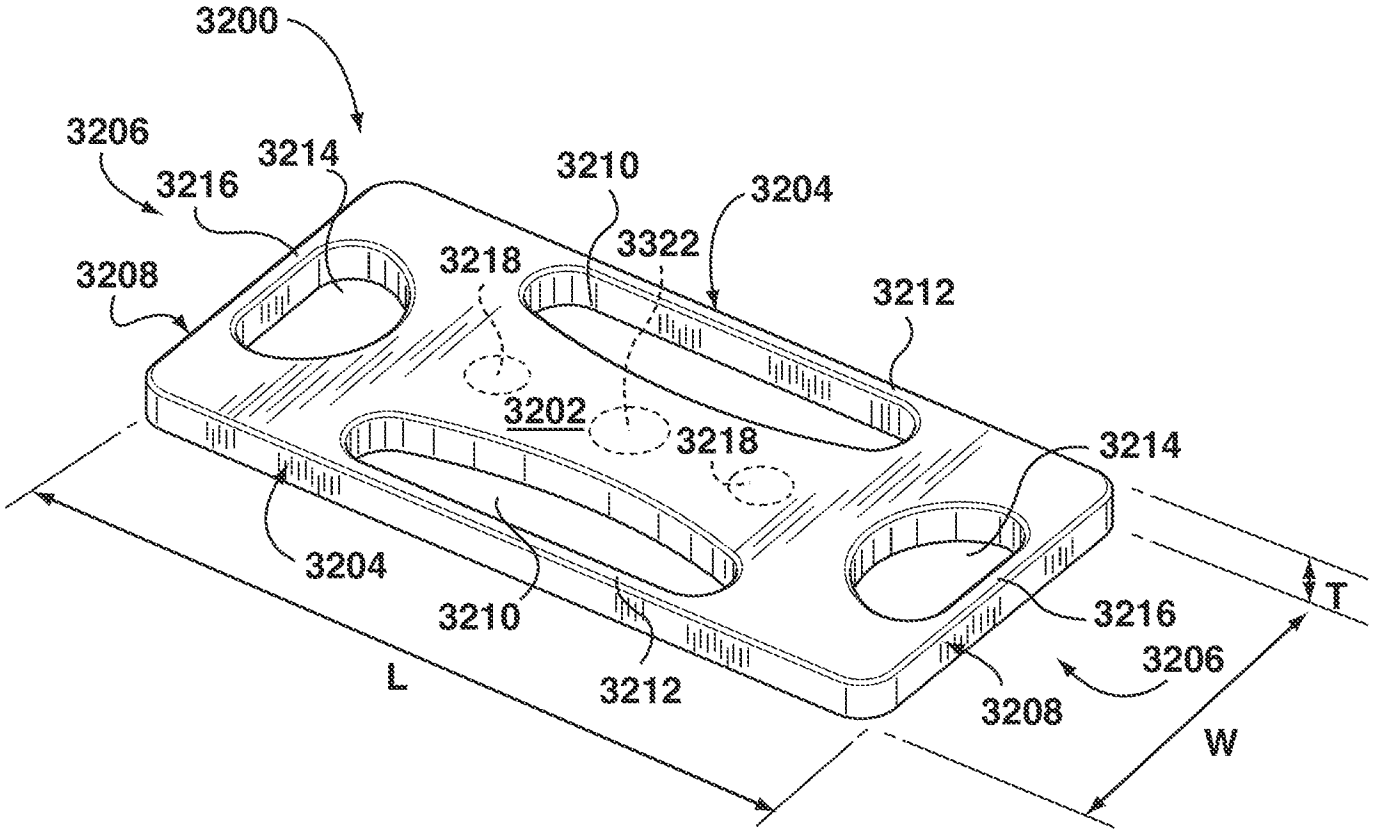
FIG. 32 shows a perspective view of a twenty-eighth exemplary exercise weight.
Figure 33:
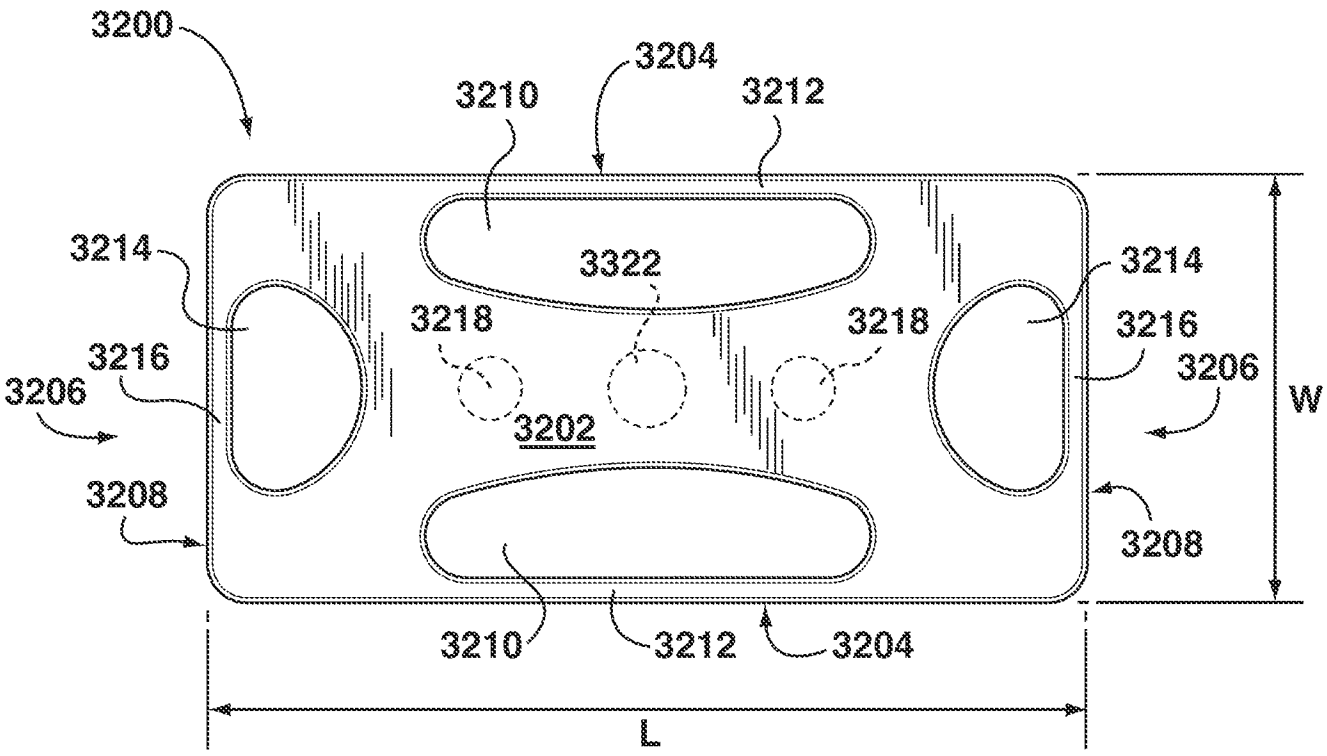
FIG. 33 shows a plan view of the exercise weight of FIG. 32.
Figure 34:
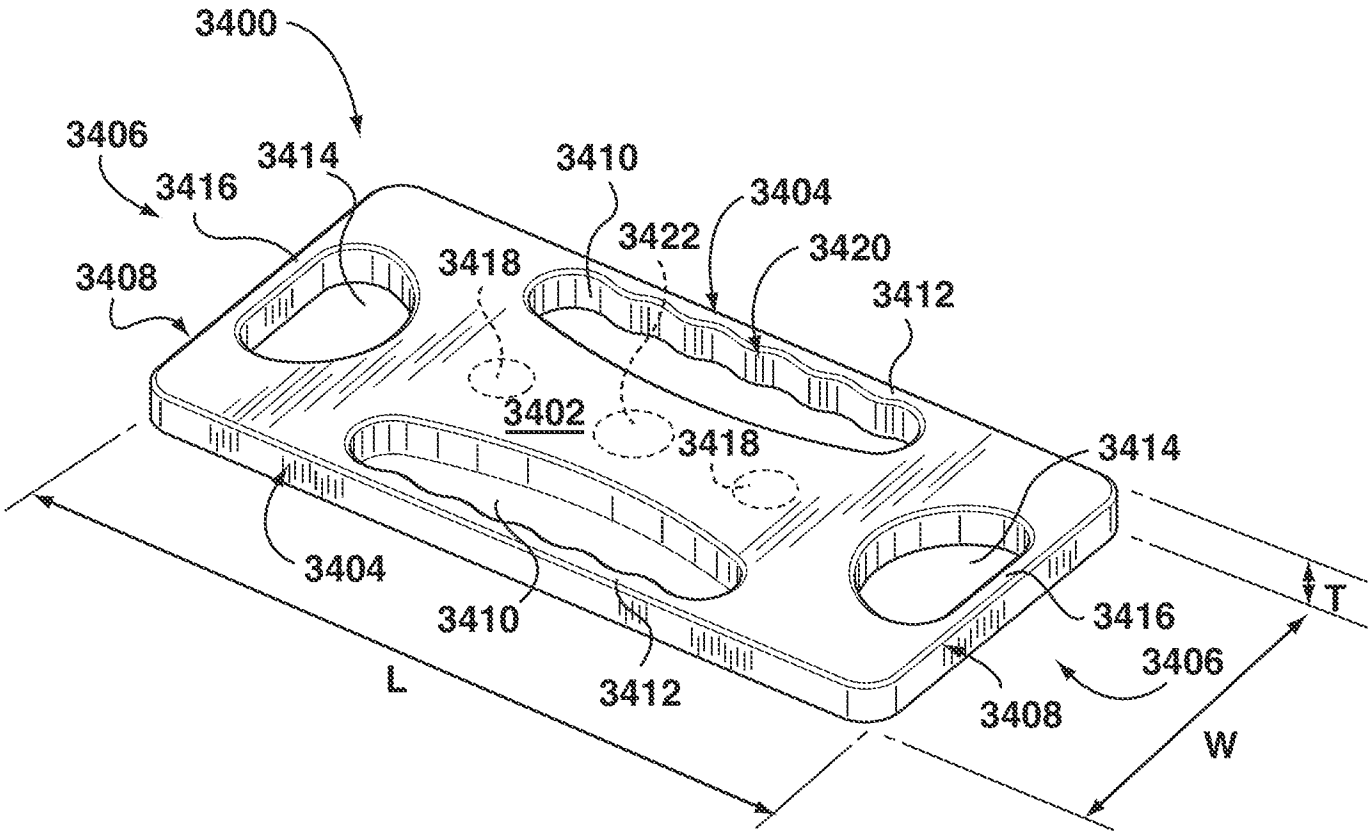
FIG. 34 shows a perspective view of a twenty-ninth exemplary exercise weight.
Figure 35:
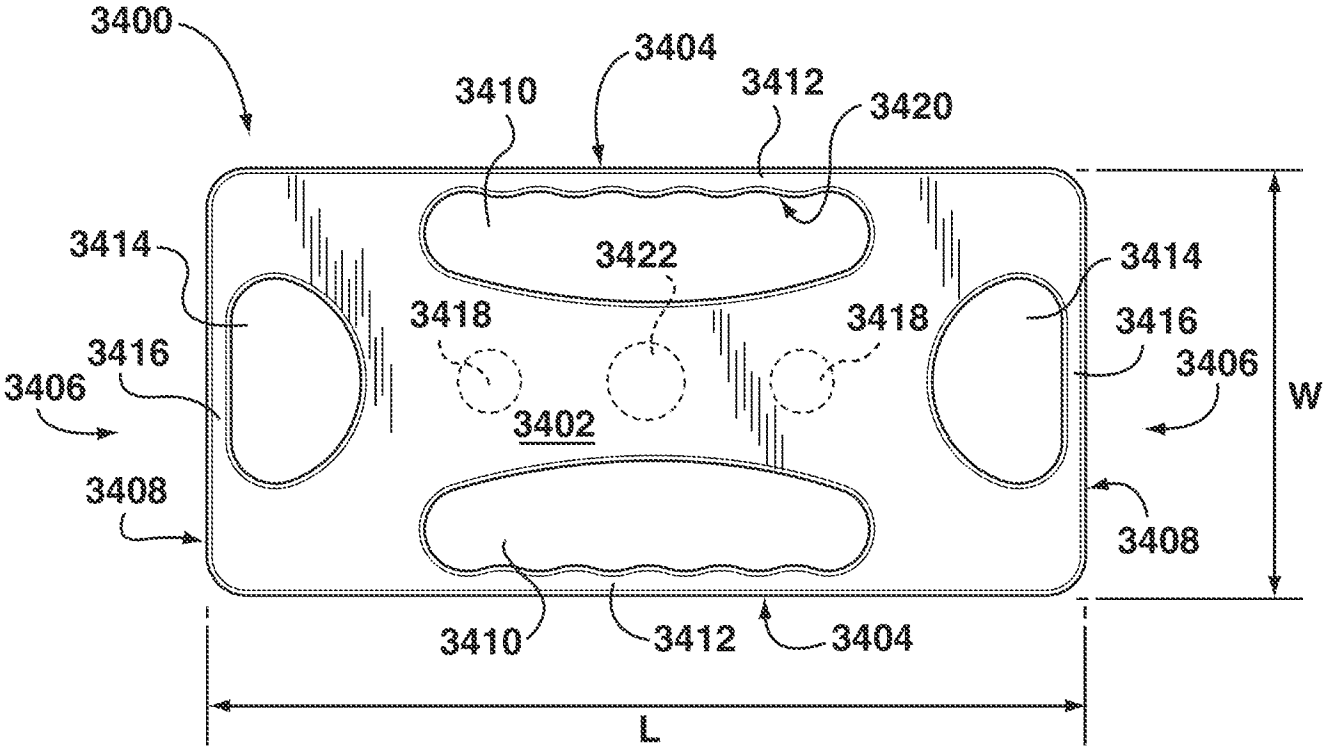
FIG. 35 shows a plan view of the exercise weight of FIG. 34.

Reference is now made to FIGS. 29 to 31, in which an exemplary barbell is indicated generally by the reference numeral 2900. The barbell 2900 may be made from any suitable material, such as steel, for example, and the various components may be welded together.

The barbell 2900 comprises a main support portion 2940 for receiving exercise weights, such as the exercise weights described above, as well as a pair of opposed first lifting handles 2942 extending outwardly from opposite ends of the main support portion 2940 and an elongated lifting bar 2944 carried by the main support portion 2940. Although FIG. 31 shows the barbell 2900 in use with the exercise weight 100 shown in FIGS. 1 and 2, it may be used with any of the exercise weights shown and described herein.

In the illustrated embodiment, the main support portion 2940 includes two spaced apart mounting projections 2946 that correspond in size, shape and position to the spaced apart mounting apertures 118 defined through the plate 102. As such, each mounting projection 2946 is adapted to be received in a corresponding mounting aperture 118 in the weight 100 for supporting the weight 100 on the barbell 2900, as shown in FIG. 31. Removable spring clips may be placed on the mounting projections to secure the plate 102 on the barbell 2900. In other embodiments, for example where the lengthwise grip apertures and/or the end grip apertures of the weight are used to mount the weight on the barbell, the barbell may include mounting projections that correspond in size, shape and position to the lengthwise grip apertures and/or the end grip apertures, or may include a single mounting projection corresponding in size, shape and position to one of the lengthwise grip apertures.

The barbell 2900 further comprises a pair of spaced-apart legs 2948 each extending from longitudinal ends of the main support portion 2940 away from the lifting bar 2944. The legs 2948 are of equal length, and assist in supporting the barbell 2900 on a surface while mounting the exercise weights thereon. In the illustrated embodiment, a crossbar 2950 extends between the legs 2948 for increased strength and stability.

The elongated lifting bar 2944 is spaced from and extends along the main support portion 2940; in the illustrated embodiment this spacing is achieved by a pair of spaced-apart spacer arms 2952 extending between the main support portion 2940 and the lifting bar 2944. In the illustrated embodiment shown in FIGS. 29 through 31, the spacer arms 2952 are positioned opposite the legs 2948 and the lifting bar 2944 extends between the spacer arms so that the spacer arms define the ends of the lifting bar 2944. In other embodiments, the lifting bar may extend beyond the spacer arms. The lifting bar 2944 preferably includes outwardly bowed grip portions 2954 at opposite ends thereof.

In the illustrated embodiment shown in FIGS. 29 to 31, the barbell 2900 also includes a pair of opposed second lifting handles 2956, each of which extends from a respective one of the first lifting handles 2942. The second lifting handles 2956 extend away from the lifting bar 2944, and in the illustrated embodiment are substantially normal to the first lifting handles 2942, although in other embodiments the second lifting handles 2956 may form different angles with the respective first lifting handles 2942, such as an approximate 45 degree angle.

When one or more of the exemplary exercise weights are mounted on the exemplary barbell 2900, for example when the exemplary exercise weight 100 is so mounted as shown in FIG. 31, a user may exercise with the loaded barbell 2900 by gripping any of the first lifting handles 2942, the second lifting handles 2956 or the lifting bar 2944. In addition, a user can grip the lengthwise handgrips or the end handgrips of the exercise weight to use the exercise weight, or a plurality of exercise weights arranged in registration with one another, independently of any barbell.

Exercise weights as described herein may also be adapted for use with a conventional barbell, such as a standard men's Olympic-style whose outer ends, used for mounting the weight, measure 50 millimeters (2.0 inches) in diameter.

FIGS. 32 and 33 and FIGS. 34 and 35 show, respectively, exemplary exercise weights 3200 and 3400 that are similar to the exemplary exercise weight 100 shown in FIG. 1. As such, corresponding reference numerals are used to refer to corresponding features, except with the prefix "32" or "34" instead of "1". The exemplary exercise weights 3200 and 3400 differ from the exemplary exercise weight 100 in that the plate 3202, 3402 includes a central mounting aperture 3222, 3422 defined through the centroid of mass of the plate 3202, 3402 for mounting the plate 3202, 3402 on a conventional barbell. The central mounting aperture 3222, 3422 maybe in addition to the opposed, spaced-apart mounting apertures 3218, 3418, in which case it may be disposed between them as shown, or as an alternative to the opposed, spaced-apart mounting apertures 3218, 3418. The exemplary exercise weights 3200 and 3400 also differ from the exemplary exercise weight 100 in that the lengthwise grip apertures 3210, 3410 and end grip apertures 3214, 3414 and 2814 each have a generally reniform shape. Moreover, the lengthwise handgrips 3412 of the exemplary exercise weights 3400 shown in FIGS. 34 and 35 have an undulating inner edge to enhance grip; an undulating inner edge may optionally by provided on the end handgrips as well.

Several currently preferred embodiments have been described by way of example. It will be apparent to persons skilled in the art that a number of variations and modifications can be made without departing from the scope of the claims.

What is claimed is:

1. An exercise weight, comprising:

a plate having a width, a length and a thickness;

the length substantially greater than the width;

the width substantially greater than the thickness;

the plate having opposed longitudinal edges defined by the length and opposed longitudinal ends having end edges;

the plate having at least one pair of opposed lengthwise grip apertures defined through the plate adjacent respective ones of the opposed longitudinal edges thereof;

each lengthwise grip aperture cooperating with its respective longitudinal edge to form a lengthwise handgrip;

the plate having at least one pair of opposed end grip apertures defined through the plate adjacent respective ones of the end edges thereof;

each end grip aperture cooperating with its respective end edge to form an end handgrip; and at least one mounting aperture defined through the plate for mounting the weight on a barbell;

the at least one mounting aperture disposed inwardly of the lengthwise grip apertures and the end grip apertures.

2. The exercise weight of claim 1, wherein the at least one mounting aperture comprises at least one pair of opposed mounting apertures.

3. The exercise weight of claim 1, wherein the at least one mounting aperture comprises a central mounting aperture defined through a centroid of mass of the plate.

4. The exercise weight of claim 1, wherein the at least one mounting aperture comprises:

a central mounting aperture defined through a centroid of mass of the plate; and at least one pair of opposed mounting apertures in addition to the central mounting aperture.

5. The exercise weight of claim 1, wherein the at least one pair of opposed lengthwise grip apertures is a single pair of opposed lengthwise grip apertures.

6. The exercise weight of claim 1, wherein the at least one pair of opposed end grip apertures is a single pair of opposed end grip apertures.

7. The exercise weight of claim 1, wherein the length is at least double the width.

8. The exercise weight of claim 1, wherein the plate has a generally rectangular parallelepipedic shape.

9. The exercise weight of claim 6, wherein the plate has rounded corners.

10. The exercise weight of claim 1, wherein the longitudinal edges have a convex curvature.

11. The exercise weight of claim 1, wherein the longitudinal edges have a concave curvature.

12. The exercise weight of claim 1, wherein the end edges have a convex curvature.

13. The exercise weight of claim 1, wherein the end edges have a concave curvature.

14. A barbell, comprising:

a main support portion for receiving exercise weights;

the main support portion including at least one mounting projection, each mounting projection adapted to be received in a corresponding aperture in one of the exercise weights for supporting the exercise weight on the barbell;

a pair of opposed first lifting handles extending outwardly from opposite ends of the main support portion;

an elongated lifting bar carried by the main support portion;

the elongated lifting bar spaced from and extending along the main support portion; and a pair of opposed second lifting handles;

each of the second lifting handles extending from a respective one of the first lifting handles and extending away from the lifting bar.

15. The barbell of claim 14, further comprising a pair of spaced-apart legs each extending from the main support portion away from the lifting bar for supporting the barbell on a surface while mounting the exercise weights thereon.

16. The barbell of claim 15, further comprising:

a pair of spacer arms extending between the main support portion and the lifting bar;

the spacer arms positioned opposite the legs.

17. The barbell of claim 15, further comprising a crossbar extending between the legs.

18. The barbell of claim 16, wherein the lifting bar extends between the spacer arms so that the spacer arms define ends of the lifting bar.

19. The barbell of claim 14, wherein the lifting bar includes outwardly bowed grip portions at opposite ends thereof.

20. The barbell of claim 14, wherein the at least one mounting projection comprises two spaced apart mounting projections.

* * * * *